US008238790B2

(12) United States Patent
Furuya et al.

(10) Patent No.: US 8,238,790 B2
(45) Date of Patent: Aug. 7, 2012

(54) IMAGE FORMING APPARATUS WITH IMPROVED HOUSING PANEL STRUCTURAL STRENGTH

(75) Inventors: Masaharu Furuya, Yokohama (JP); Takuya Sekine, Yokohama (JP); Masakazu Imai, Yokohama (JP); Katsuhito Haruno, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 374 days.

(21) Appl. No.: 12/568,897

(22) Filed: Sep. 29, 2009

(65) Prior Publication Data

US 2010/0080625 A1 Apr. 1, 2010

(30) Foreign Application Priority Data

Sep. 30, 2008 (JP) ..... 2008-253025

(51) Int. Cl.
*G03G 15/08* (2006.01)

(52) U.S. Cl. ..... 399/121; 399/308

(58) Field of Classification Search ..... 399/121, 399/308

See application file for complete search history.

(56) References Cited

U.S. PATENT DOCUMENTS

| | | | | |
|---|---|---|---|---|
| 6,006,051 | A | 12/1999 | Tomita et al. | |
| 7,221,887 | B2 | 5/2007 | Kimura et al. | |
| 7,277,667 | B2 | 10/2007 | Saito et al. | |
| 7,421,239 | B2 | 9/2008 | Kimura et al. | |
| 2001/0051059 | A1 | 12/2001 | Morikami et al. | |
| 2005/0169667 | A1 | 8/2005 | Katoh | |
| 2006/0072929 | A1 * | 4/2006 | Takahashi | 399/13 |
| 2008/0112734 | A1 | 5/2008 | Furuya et al. | |
| 2008/0118281 | A1 | 5/2008 | Saeki et al. | |
| 2008/0175621 | A1 | 7/2008 | Furuya et al. | |
| 2008/0181681 | A1 * | 7/2008 | Yang | 399/302 |
| 2008/0187343 | A1 | 8/2008 | Yamaguchi et al. | |
| 2008/0298833 | A1 | 12/2008 | Kimura et al. | |
| 2009/0003864 | A1 | 1/2009 | Yamaguchi et al. | |
| 2009/0110436 | A1 * | 4/2009 | Sugiyama | 399/121 |

FOREIGN PATENT DOCUMENTS

| | | |
|---|---|---|
| JP | 2004-138927 | 5/2004 |
| JP | 2004-138945 | 5/2004 |
| JP | 3782544 | 3/2006 |
| JP | 2008-145743 | 6/2008 |

OTHER PUBLICATIONS

A Machine Translation of JP-2004-138945.*
U.S. Appl. No. 12/828,612, filed Jul. 1, 2010, Furuya, et al.
U.S. Appl. No. 12/486,351, filed Jun. 17, 2009, Takuya Sekina, et al.
U.S. Appl. No. 12/499,332, filed Jul. 8, 2009, Masaharu Furuya, et al.

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

In an image forming apparatus, a moving member is provided with a first engagement member. A lever is provided with a second engagement member to engage and disengage the first engagement member provided in the moving member. The lever moves between a predetermined first position and a second position different from the first position to move the moving member in such a manner that when the lever is at the first position, a transfer member reaches a contact position at which the transfer member is pressed against an image carrier via a belt, and when the lever is at the second position, the transfer member reaches a separation position at which the transfer member separates from the image carrier.

8 Claims, 15 Drawing Sheets

IMAGE FORMING APPARATUS WITH IMPROVED HOUSING PANEL STRUCTURAL STRENGTH

CROSS-REFERENCE TO RELATED APPLICATION

The present application is based on and claims priority to Japanese Patent Application No. 2008-253025, filed on Sep. 30, 2008, in the Japan Patent Office, which is hereby incorporated herein by reference in its entirety.

BACKGROUND OF THE INVENTION

1. Field of the Invention

Exemplary aspects of the present invention relate to an image forming apparatus, and more particularly, to an image forming apparatus including a unit detachably attached to the image forming apparatus.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of a photoconductor; an optical writer emits a light beam onto the charged surface of the photoconductor to form an electrostatic latent image on the photoconductor according to the image data; a development device supplies toner particles to the electrostatic latent image formed on the photoconductor to make the electrostatic latent image visible as a toner image; the toner image is directly transferred from the photoconductor onto a recording medium or is indirectly transferred from the photoconductor onto a recording medium via an intermediate transfer belt; a cleaner then cleans the surface of the photoconductor after the toner image is transferred from the photoconductor onto the recording medium; finally, a fixing device applies heat and pressure to the recording medium bearing the toner image to fix the toner image on the recording medium, thus forming the image on the recording medium.

In such image forming apparatuses, when the photoconductor and an intermediate transfer unit including the intermediate transfer belt wound around a plurality of support rollers reach the end of their life, a user removes the photoconductor and the intermediate transfer unit through openings provided in a front housing panel of the image forming apparatus in an axial direction of the photoconductor and the plurality of support rollers to replace the photoconductor and the intermediate transfer unit with new ones, respectively. Specifically, the front housing panel of the image forming apparatus includes one opening through which the photoconductor is attached to and detached from the image forming apparatus and another opening though which the intermediate transfer unit is attached to and detached from the image forming apparatus. However, the inclusion of such openings may weaken the front housing panel.

To address this, the front housing panel of the image forming apparatus may include one opening through which the photoconductor is attached to and detached from the image forming apparatus while another opening through which the intermediate transfer unit is attached to and detached from the image forming apparatus is formed in a side housing panel of the image forming apparatus. With such a configuration, for example, the photoconductor is inserted into and removed from the image forming apparatus through the opening of the front housing panel in the axial direction of the photoconductor whereas the intermediate transfer unit is inserted into and removed from the image forming apparatus through the opening of the side housing panel in a direction perpendicular to the axial direction of the photoconductor or the plurality of support rollers.

At the same time, however, the basic architecture of the image forming apparatus makes such replacement somewhat difficult. That is, when the photoconductor and the intermediate transfer unit are set in the image forming apparatus to perform an image forming operation, a transfer roller provided inside a loop formed by the intermediate transfer belt of the intermediate transfer unit is pressed against the photoconductor via the intermediate transfer belt. When the photoconductor or the intermediate transfer unit is attached to and detached from the image forming apparatus while the photoconductor and the transfer roller nip the intermediate transfer belt, the surface of the photoconductor slides over the surface of the intermediate transfer belt. Accordingly, the surfaces of the photoconductor and the intermediate transfer belt may be damaged during replacement.

To address this, a moving mechanism for moving the transfer roller with respect to the photoconductor and a lever for moving the moving mechanism may be provided on the intermediate transfer unit. For example, when the photoconductor or the intermediate transfer unit is attached to and detached from the image forming apparatus, the user rotates the lever to move the moving mechanism so that the moving mechanism separates the transfer roller from the photoconductor. Accordingly, the surface of the photoconductor does not contact the surface of the intermediate transfer belt, thereby minimizing any damage to the surfaces of both the photoconductor and the intermediate transfer belt.

The lever operated by the user is provided on the intermediate transfer unit in such a manner that the lever protrudes from the front housing panel of the image forming apparatus toward the user to make the lever more accessible to the user. Accordingly, an opening through which the lever protrudes toward the user is provided in the front housing panel of the image forming apparatus. The opening needs to be large enough to accommodate a range of motion or orbit of the rotating lever so that the lever can be operated without interfering with the front housing panel of the image forming apparatus. However, an opening of that size can structurally weaken the front housing panel of the image forming apparatus.

BRIEF SUMMARY OF THE INVENTION

This specification describes below an image forming apparatus according to an exemplary embodiment of the present invention. In one exemplary embodiment of the present invention, the image forming apparatus includes an image carrier, a toner image formation member, a belt unit, a first housing panel, a second housing panel, and a lever.

The toner image formation member forms a toner image on the image carrier. The belt unit includes a loop-shaped belt, a plurality of support members rotatably supporting the belt, a transfer member, and a moving member. The transfer member is movably provided inside a loop formed by the belt to transfer the toner image formed on the image carrier onto one of the belt and a sheet carried by the belt. The moving member is provided inside the loop formed by the belt to move the transfer member between a contact position at which the transfer member is pressed against the image carrier via the belt and a separation position at which the transfer member separates from the image carrier. The moving member is provided with a first engagement member. The first housing panel includes a first opening sized to allow the image carrier to be attached to and detached from the image forming apparatus in an axial direction of the plurality of support members. The second housing panel includes a second opening sized to allow the belt unit to be attached to and detached from the image forming apparatus in a direction perpendicular to the axial direction of the plurality of support members.

The lever is provided on an outer side of the first housing panel, and is provided with a second engagement member engaging and disengaging the first engagement member provided in the moving member in the axial direction of the plurality of support members. The lever is movable between a predetermined first position and a second position different from the first position to move the moving member in such a manner that when the lever is at the first position, the transfer member reaches the contact position, and when the lever is at the second position, the transfer member reaches the separation position.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
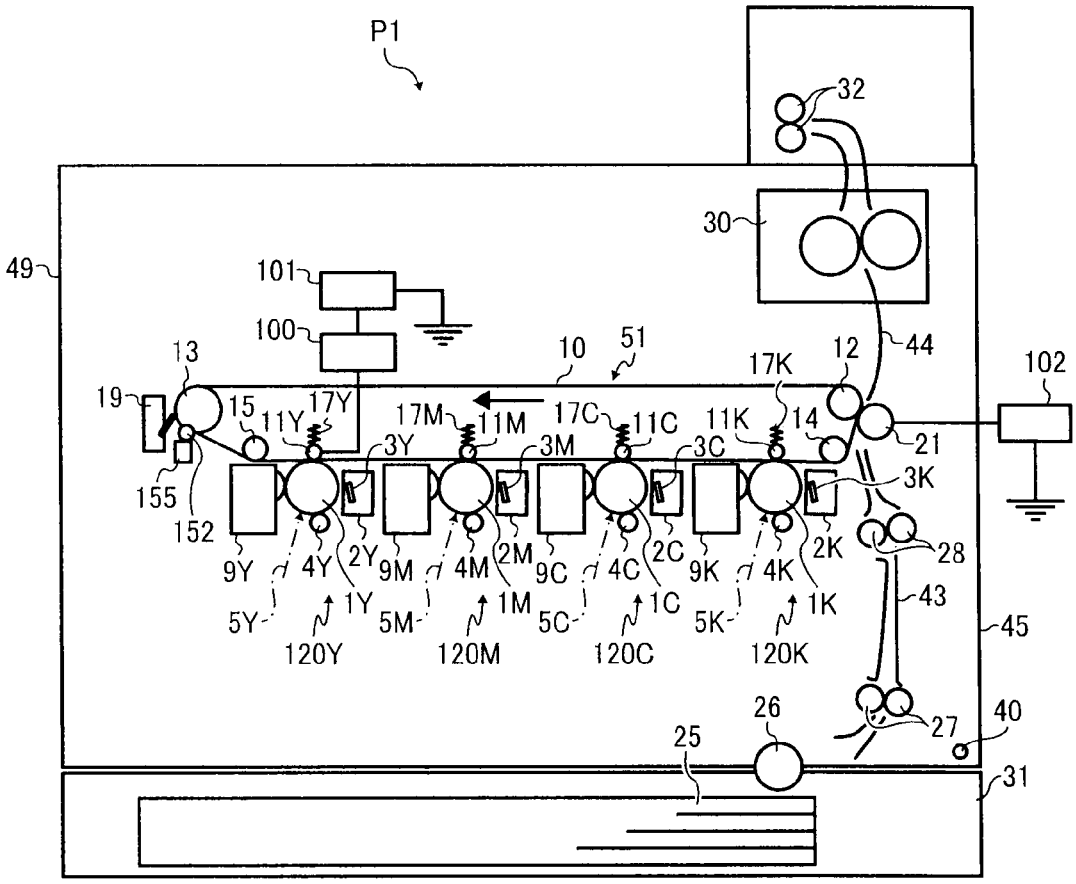
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus P1 according to an exemplary embodiment of the present invention is explained.

FIG. 1 is a schematic view of the image forming apparatus P1. As illustrated in FIG. 1, the image forming apparatus P1 includes a belt cleaning unit 19, a second transfer roller 21, a feed roller 26, a conveyance roller pair 27, a registration roller pair 28, a fixing device 30, a paper tray 31, an output roller pair 32, a swing shaft 40, a feed path 43, a post-transfer conveyance path 44, a side outer cover 45, a housing 49, an intermediate transfer unit 51, power sources 100, 101, and 102, and image forming units 120Y, 120M, 120C, and 120K.

The belt cleaning unit 19 includes a lubricant applier 152 and a solid lubricant 155.

The intermediate transfer unit 51 includes an intermediate transfer belt 10, a driving roller 12, a tension roller 13, support rollers 14 and 15, first transfer rollers 11Y, 11M, 11C, and 11K, and springs 17Y, 17M, 17C, and 17K.

The image forming units 120Y, 120M, 120C, and 120K include photoconductors 1Y, 1M, 1C, and 1K, cleaners 2Y, 2M, 2C, and 2K, chargers 4Y, 4M, 4C, and 4K, and development devices 9Y, 9M, 9C, and 9K, respectively. The cleaners 2Y, 2M, 2C, and 2K include cleaning blades 3Y, 3M, 3C, and 3K, respectively.

Figure 2:
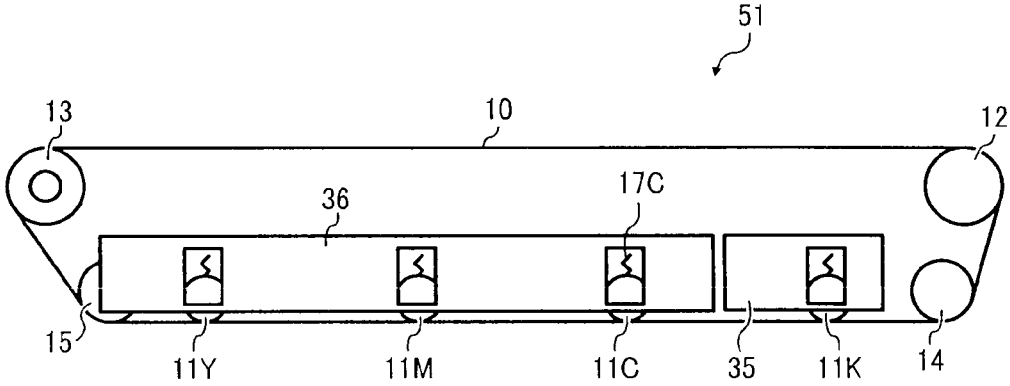
FIG. 2 is a schematic view of an intermediate transfer unit included in the image forming apparatus shown in FIG. 1.

FIG. 2 is a schematic view of the intermediate transfer unit 51. As illustrated in FIG. 2, the intermediate transfer unit 51 further includes a black sub frame 35 and a full-color sub frame 36.

As illustrated in FIG. 1, the image forming apparatus P1 can be a copier, a facsimile machine, a printer, a plotter, a multifunction printer having at least one of copying, printing, scanning, plotter, and facsimile functions, or the like, for forming an image on a recording medium by electrophotography. According to this exemplary embodiment, the image forming apparatus P1 functions as a tandem color printer for forming a color image on a recording medium by electrophotography.

The intermediate transfer unit 51 is detachably attached to the image forming apparatus P1, and is provided in a center portion of the image forming apparatus P1. In the intermediate transfer unit 51, four support rollers support the intermediate transfer belt 10 serving as a belt or an image carrier. Specifically, the intermediate transfer belt 10 is looped over the driving roller 12, the tension roller 13, and the two support rollers 14 and 15 serving as a plurality of support members. The driving roller 12 serves as a second transfer opposing roller for opposing the second transfer roller 21 via the intermediate transfer belt 10. A driving motor drives the driving roller 12 at a process speed of about 150 mm/s.

The intermediate transfer belt 10 has a resistance value capable of transferring a toner image formed on each of the photoconductors 1Y, 1M, 1C, and 1K, serving as an image carrier, onto the intermediate transfer belt 10. For example, the intermediate transfer belt 10 includes one or more layers including PVDF (polyvinylidene fluoride), ETFE (ethylene tetrafluoroethylene copolymer), PI (polyimide), and/or PC (polycarbonate) and being dispersed with a conductive material such as carbon black to have a volume resistivity in a range from about $10^8$ Ω·cm to about $10^{12}$ Ω·cm and a surface resistivity of about $10^9$ Ω·cm to about $10^{13}$ Ω·cm.

A surface of the intermediate transfer belt 10 may be coated with a releasing layer including fluoroplastic such as ETFE, PTFE (polytetrafluoroethylene), PVDF, PEA (perfluoroalkoxy fluoroplastic), FEP (tetrafluoroethylene-hexafluoropropylene copolymer), and PVF (polyvinyl formal), as needed. Alternatively, the releasing layer may include other material.

The intermediate transfer belt 10 is manufactured by cast molding, centrifugal molding, or the like. The surface of the intermediate transfer belt 10 may be ground as needed.

When the volume resistivity of the intermediate transfer belt 10 exceeds the above-described range, a higher bias is needed to transfer the toner image, increasing power costs. Further, the intermediate transfer belt 10 is charged with a high potential in a transfer process for transferring the toner image and a separation process for separating a transfer sheet serving as a recording medium from the intermediate transfer belt 10, and self-discharge of the intermediate transfer belt 10 becomes difficult. Accordingly, a discharger is needed.

When the volume resistivity and the surface resistivity of the intermediate transfer belt 10 are below the above-described ranges, respectively, the potential of the charged intermediate transfer belt 10 attenuates faster, and the intermediate transfer belt 10 is discharged easily by self-discharge. However, an electric current flows in a surface direction when the toner image is transferred, spattering toner particles. To address those problems, the intermediate transfer belt 10 according to this exemplary embodiment has the volume resistivity and the surface resistivity in the above-described ranges, respectively.

The volume resistivity and the surface resistivity of the intermediate transfer belt 10 were measured with a high resistivity meter (e.g., Hiresta IP available from Mitsubishi Chemical Corporation) connected to an HRS probe having an internal electrode diameter of 5.9 mm and a ring electrode inner diameter of 11.0 mm. A voltage of 100 V was applied to inner and outer surfaces of the intermediate transfer belt 10 for ten seconds to measure the volume resistivity of the intermediate transfer belt 10. A voltage of 500 V was applied to measure the surface resistivity of the intermediate transfer belt 10.

The four image forming units 120Y, 120M, 120C, and 120K are provided below the intermediate transfer belt 10 along a moving region in which the intermediate transfer belt 10 moves. In the cleaners 2Y, 2M, 2C, and 2K, the cleaning blades 3Y, 3M, 3C, and 3K clean surfaces of the photoconductors 1Y, 1M, 1C, and 1K, respectively. An optical writer, serving as a latent image forming device provided in a lower portion of the image forming apparatus P1, emits lights 5Y, 5M, 5C, and 5K onto the surfaces of the photoconductors 1Y, 1M, 1C, and 1K to form latent images on the photoconductors 1Y, 1M, 1C, and 1K, respectively. Thus, the photoconductors 1Y, 1M, 1C, and 1K serve as latent image carriers for carrying the latent images, respectively.

The springs 17Y, 17M, 17C, and 17K press the first transfer rollers 11Y, 11M, 11C, and 11K against the photoconductors 1Y, 1M, 1C, and 1K, respectively, via the intermediate transfer belt 10. The first transfer rollers 11Y, 11M, 11C, and 11K serve as transfer bias rollers, respectively, and contact an inner surface of the intermediate transfer belt 10 at positions at which the first transfer rollers 11Y, 11M, 11C, and 11K oppose the photoconductors 1Y, 1M, 1C, and 1K, respectively. The power sources 100 and 101 apply a predetermined transfer bias (e.g., +1,800 V) to the first transfer rollers 11Y, 11M, 11C, and 11K.

As illustrated in FIG. 2, the black sub frame 35 provided in the intermediate transfer unit 51 supports the first transfer roller 11K at the position inside a loop formed by the intermediate transfer belt 10 at which the first transfer roller 11K opposes the photoconductor 1K depicted in FIG. 1. Similarly, the full-color sub frame 36 provided in the intermediate transfer unit 51 supports the first transfer rollers 11Y, 11M, and 11C at the positions inside the loop formed by the intermediate transfer belt 10 at which the first transfer rollers 11Y, 11M, and 11C oppose the photoconductors 1Y, 1M, and 1C depicted in FIG. 1, respectively.

The black sub frame 35 and the full-color sub frame 36 are disposed in the intermediate transfer unit 51 to provide a simple contact-separate mechanism for contacting and separating the first transfer rollers 11Y, 11M, 11C, and 11K to and from the intermediate transfer belt 10.

Specifically, when the image forming apparatus P1 forms a monochrome image, the three first transfer rollers 11Y, 11M, and 11C held by the full-color sub frame 36 are not used. Accordingly, a driver generates a driving force to move the full-color sub frame 36 so that the three first transfer rollers 11Y, 11M, and 11C held by the full-color sub frame 36 separate from the intermediate transfer belt 10 simultaneously.

By contrast, when the image forming apparatus P1 forms a color image, the driver generates a driving force to move the full-color sub frame 36 so that the three first transfer rollers 11Y, 11M, and 11C held by the full-color sub frame 36 contact the intermediate transfer belt 10 simultaneously. When the formation of the color image is finished, the driver moves the full-color sub frame 36 so that the three first transfer rollers 11Y, 11M, and 11C held by the full-color sub frame 36 separate from the intermediate transfer belt 10 simultaneously. Thus, the simple contact-separate mechanism can contact and separate the three first transfer rollers 11Y, 11M, and 11C to and from the intermediate transfer belt 10 at a time more effectively than a mechanism for moving the three first transfer rollers 11Y, 11M, and 11C separately from each other.

As illustrated in FIG. 1, the second transfer roller 21 opposes the driving roller 12 via the intermediate transfer belt 10. In other words, the second transfer roller 21 faces the surface of the intermediate transfer belt 10 at a position at which the intermediate transfer belt 10 is looped over the driving roller 12. The power source 102 applies a predetermined second transfer bias to the second transfer roller 21. A second transfer portion (e.g., a second transfer nip) is formed between the second transfer roller 21 and the intermediate transfer belt 10 at the position at which the intermediate transfer belt 10 is looped over the driving roller 12.

The second transfer roller 21 includes a metal core including SUS stainless steel and an elastic body covering the metal core. The elastic body includes urethane adjusted by a conductive material to have a resistance in a range from about $10^6\Omega$ to about $10^{10}\Omega$.

When the resistance of the second transfer roller 21 exceeds the above-described range, an electric current does not flow on the second transfer roller 21 easily. To address this, a high voltage is applied to the second transfer roller 21 to transfer a toner image formed on the intermediate transfer belt 10 onto a transfer sheet, resulting in increased power costs. The high voltage applied to the second transfer roller 21 generates discharge in spaces provided upstream and downstream from the second transfer nip in a sheet conveyance direction. Accordingly, the discharge generates white spots on a halftone image formed on the transfer sheet.

By contrast, when the resistance of the second transfer roller 21 is below the above-described range, the second transfer roller 21 may not transfer both a superimposed portion (e.g., a color toner image formed by superimposing toner images in three colors) and a monochrome portion (e.g., a monochrome toner image) of a single toner image onto the transfer sheet.

Specifically, when the resistance of the second transfer roller 21 is low, a relatively low voltage flows an electric current capable of transferring the monochrome portion of the toner image. However, a higher voltage, which is higher than the voltage capable of transferring the monochrome portion of the toner image, is needed to transfer the superimposed portion of the toner image. Accordingly, when a voltage capable of transferring the superimposed portion of the toner image is applied to the second transfer roller 21, such voltage generates an excessive electric current for the monochrome portion of the toner image, resulting in decreased transfer efficiency.

The resistance of the second transfer roller 21 was calculated based on an electric current flowing when a voltage of 1,000 V was applied between the core of the second transfer roller 21 and a conductive metal plate on which the second transfer roller 21 was provided, in a condition in which a load of 4.9 N was applied on each of both ends of the core of the second transfer roller 21, that is, in a condition in which a total load of 9.8 N was applied on both ends of the core of the second transfer roller 21.

A driving gear applies a driving force to the second transfer roller 21. A circumferential velocity of the second transfer roller 21 is substantially identical with a circumferential velocity of the intermediate transfer belt 10.

The feed roller 26 feeds transfer sheets 25, serving as recording media or transfer materials, loaded on the paper tray 31 one by one toward the conveyance roller pair 27. The conveyance roller pair 27 feeds the transfer sheet 25 toward the registration roller pair 28 through the feed path 43. The registration roller pair 28 feeds the transfer sheet 25 toward the second transfer roller 21. The second transfer roller 21 transfers a color toner image formed on the intermediate transfer belt 10 onto the transfer sheet 25 and feeds the transfer sheet 25 bearing the color toner image toward the fixing device 30 through the post-transfer conveyance path 44. The fixing device 30 fixes the color toner image on the transfer sheet 25 and feeds the transfer sheet 25 bearing the fixed color toner image toward the output roller pair 32.

Referring to FIG. 1, the following describes image forming operations performed by the image forming apparatus P1. The optical writer emits the lights 5Y, 5M, 5C, and 5K onto the photoconductors 1Y, 1M, 1C, and 1K, serving as image carriers, uniformly charged by the chargers 4Y, 4M, 4C, and 4K, so as to form latent images on the photoconductors 1Y, 1M, 1C, and 1K, respectively. The development devices 9Y, 9M, 9C, and 9K, serving as toner image formation members, make the latent images visible as yellow, magenta, cyan, and black toner images, respectively. The first transfer rollers 11Y, 11M, 11C, and 11K, serving as transfer members, transfer the yellow, magenta, cyan, and black toner images formed on the photoconductors 1Y, 1M, 1C, and 1K, respectively, onto the intermediate transfer belt 10, serving as a belt, successively, so that the yellow, magenta, cyan, and black toner images are superimposed on the intermediate transfer belt 10 to form a color toner image.

The feed roller 26 and the conveyance roller pair 27 feed a transfer sheet 25 toward the registration roller pair 28. The registration roller pair 28 feeds the transfer sheet 25 toward the second transfer nip formed between the second transfer roller 21 and the intermediate transfer belt 10 at a time at which a leading edge of the color toner image formed on the intermediate transfer belt 10 reaches the second transfer nip. The second transfer roller 21 transfers the color toner image formed on the intermediate transfer belt 10 onto the transfer sheet 25. According to this exemplary embodiment, a second transfer bias applied by the second transfer roller 21 is controlled to be a constant current of about +30 μA. After a discharger discharges the transfer sheet 25 bearing the color toner image, the transfer sheet 25 is sent to the fixing device 30. The fixing device 30 fixes the color toner image on the transfer sheet 25, and feeds the transfer sheet 25 bearing the fixed color toner image toward the output roller pair 32. The output roller pair 32 outputs the transfer sheet 25 onto a stack portion provided in an upper portion of the image forming apparatus P1.

When the transfer sheet 25 is jammed inside the image forming apparatus P1, a controller including a CPU (central processing unit) and a memory and being provided in the image forming apparatus P1 detects change in rotation torque of the rollers for feeding the transfer sheet 25. The controller displays a message notifying a user that the transfer sheet 25 is jammed on a control panel provided in the image forming apparatus P1 according to a detection result. The user opens an open-close cover of the image forming apparatus P1 to access a conveyance path provided in the image forming apparatus P1 to convey the transfer sheet 25 and removes the jammed transfer sheet 25 from the image forming apparatus P1. When the user closes the open-close cover after removing the jammed transfer sheet 25, the image forming apparatus P1 resumes the image forming operation.

Figure 3:
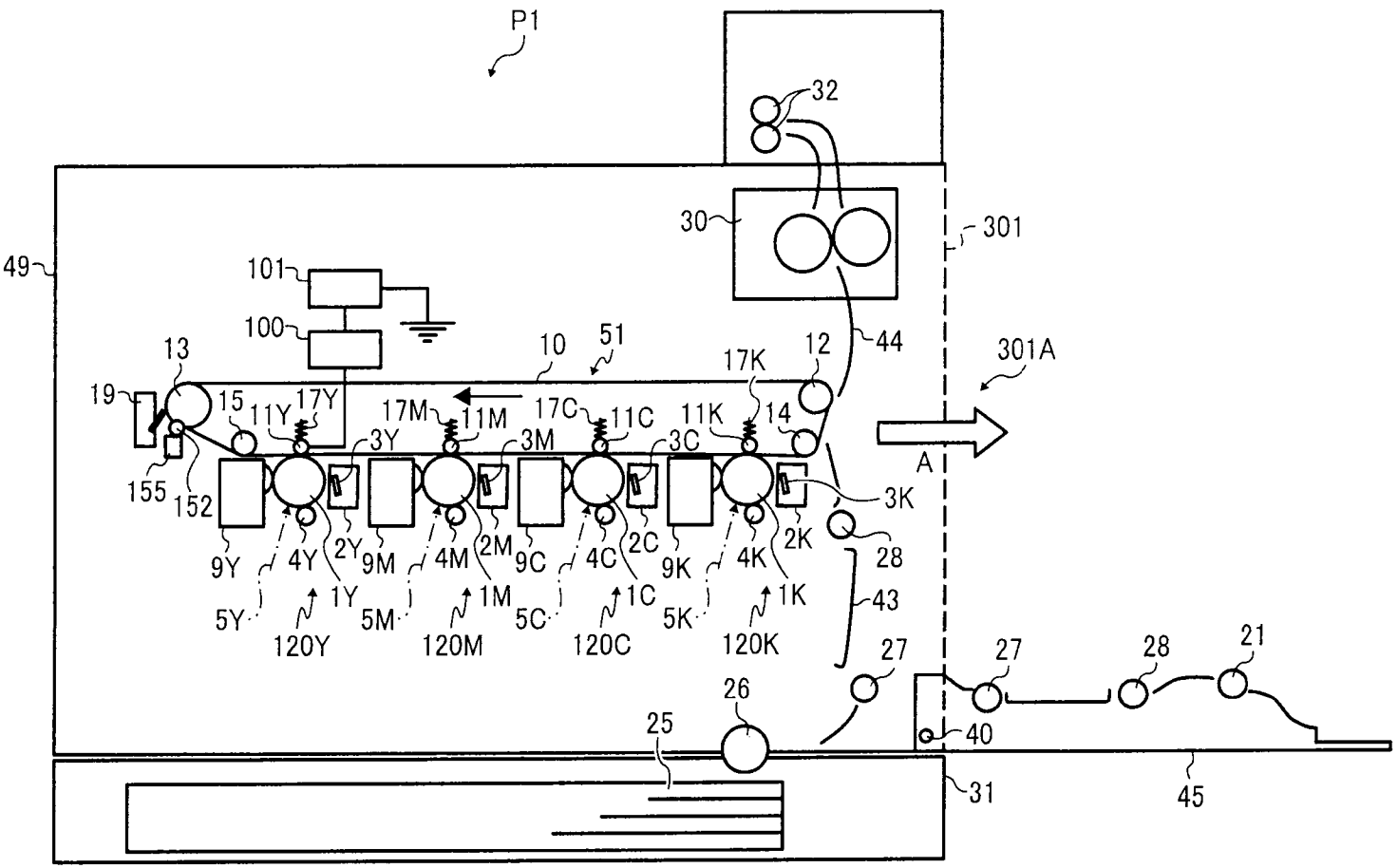
FIG. 3 is a schematic view of the image forming apparatus shown in FIG. 1 when a side outer cover included in the image forming apparatus is opened.

FIG. 3 is a schematic view of the image forming apparatus P1 when the side outer cover 45 is opened. As illustrated in FIG. 3, the housing 49 includes a side housing panel 301. The side housing panel 301 includes an opening 301A.

The side outer cover 45, serving as an open-close cover opened and closed with respect to the image forming apparatus P1, is provided at one side of the image forming apparatus P1 in such a manner that the side outer cover 45 swings about the swing shaft 40 provided in a housing panel of the image forming apparatus P1. When the side outer cover 45 is opened with respect to the image forming apparatus P1, the feed path 43, the second transfer nip, and the post-transfer conveyance path 44 are exposed to an outside of the image forming apparatus P1. Thus, the user can remove the jammed transfer sheet 25 from the feed path 43, the second transfer nip, and the post-transfer conveyance path 44 easily.

Figure 4:
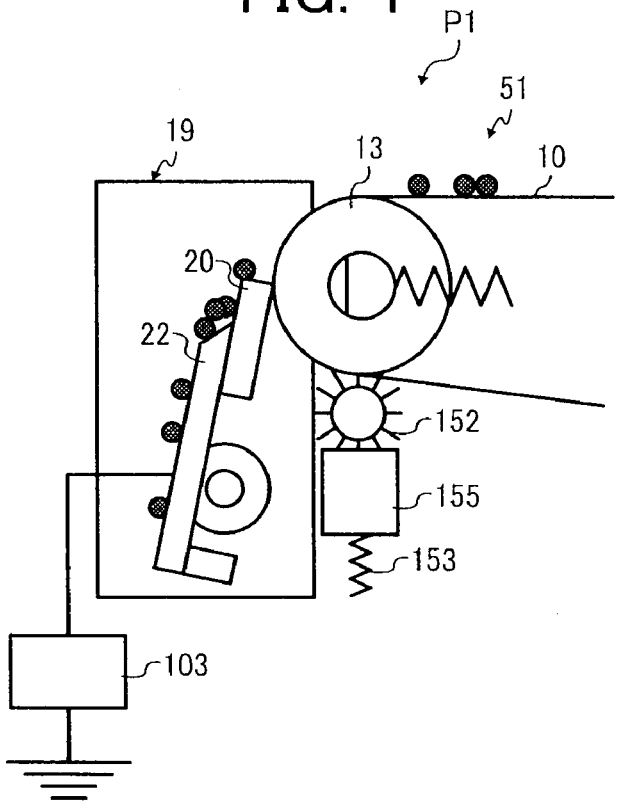
FIG. 4 is an enlarged sectional view of a belt cleaning unit and peripheral elements of the belt cleaning unit included in the image forming apparatus shown in FIG. 1.

Referring to FIG. 4, the following describes the belt cleaning unit 19. FIG. 4 is an enlarged sectional view of the belt cleaning unit 19 and peripheral elements of the belt cleaning unit 19. As illustrated in FIG. 4, the belt cleaning unit 19 further includes a cleaning blade 20, a blade holder 22, a voltage applier 103, and a lubricant pressing member 153.

The belt cleaning unit 19 removes fine particles, such as toner particles, adhered to the surface of the intermediate transfer belt 10. The cleaning blade 20 including urethane rubber is provided in the belt cleaning unit 19 in such a manner that the blade holder 22 including a metal material holds the cleaning blade 20. The belt cleaning unit 19 includes an opening at a position near the cleaning blade 20 and opposing the intermediate transfer belt 10. The cleaning blade 20 is pressed against the intermediate transfer belt 10 to stop and catch the toner particles on the intermediate transfer belt 10 to remove the toner particles from the intermediate transfer belt 10. The removed toner particles fall into the belt cleaning unit 19 through the opening. Thereafter, the toner particles are collected into a waste toner tank.

One end of the blade holder 22, which is close to a contact portion of the cleaning blade 20 contacting the intermediate transfer belt 10, is tapered to prevent toner particles removed by the cleaning blade 20 from the surface of the intermediate transfer belt 10 from accumulating on the one end of the blade holder 22. In other words, an edge surface of the one end of the blade holder 22 has a slope shape. Accordingly, the toner particles removed by the cleaning blade 20 and falling from the cleaning blade 20 slip down over the slope of the blade holder 22. Thus, the toner particles do not accumulate on the one end of the blade holder 22 easily. In other words, the toner particles accumulating on the blade holder 22 over time do not bridge between the blade holder 22 and an interior wall of the belt cleaning unit 19 to block a falling path through which the toner particles fall over the blade holder 22. Thus, the toner particles removed by the cleaning blade 20 from the surface of the intermediate transfer belt 10 do not overflow the belt cleaning unit 19.

Even when the one end of the blade holder 22 is tapered, the blade holder 22 electrically attracts the charged toner particles and therefore the charged toner particles do not slip down over the slope of the blade holder 22 and therefore accumulate on the blade holder 22 easily. To address this, the voltage applier 103 applies a predetermined voltage to the blade holder 22 including the metal material. The voltage applied by the voltage applier 103 to the blade holder 22 generates an electrostatic repulsive force to cause the toner particles adhered to the blade holder 22 to fall from the blade holder 22. According to this exemplary embodiment, the voltage applier 103 applies a voltage of +1,000 V and a voltage of −1,000 V to the blade holder 22.

The lubricant applier 152 applies the solid lubricant 155 to the surface of the intermediate transfer belt 10 so that the cleaning blade 20 cleans the surface of the intermediate transfer belt 10 easily.

The solid lubricant 155 includes fatty acid metallic salt having a straight-chain hydrocarbon structure. The fatty acid metallic salt includes at least one of fatty acids selected from stearic acid, palmitic acid, myristic acid, and oleic acid, such as fatty acid metallic salt including at least one metal selected from zinc, aluminum, calcium, magnesium, and lithium. For example, zinc stearate, which is commercially produced and widely used, is preferably used to provide reduced production costs, stable quality, and reliability. Generally, higher fatty acid metallic salt, which is industrially used, does not have a composition including a chemical compound corresponding to the name of the higher fatty acid metallic salt only, but further includes other similar fatty acid metallic salt, metal oxide, and free fatty acid more or less. The fatty acid metallic salt according to this exemplary embodiment is no exception.

The solid lubricant 155 is supplied to the intermediate transfer belt 10 in a slight amount of fine particles. For example, a brush included in the lubricant applier 152 scrapes the solid lubricant 155 having a block shape, and supplies the scraped fine particles of the solid lubricant 155 to the surface of the intermediate transfer belt 10. Alternatively, the fine particles of the solid lubricant 155 are added to toner particles, and supplied to the surface of the intermediate transfer belt 10. However, when the fine particles of the solid lubricant 155 added to the toner particles are supplied to the intermediate transfer belt 10, an amount of the supplied fine particles of the solid lubricant 155 varies depending on an image area of a toner image formed on the intermediate transfer belt 10, and therefore the fine particles of the solid lubricant 155 are not supplied to a whole surface of the intermediate transfer belt 10 constantly. To address this, according to this exemplary embodiment, the brush of the lubricant applier 152 scrapes the solid lubricant 155 to supply the fine particles of the solid lubricant 155 to the whole surface of the intermediate transfer belt 10 stably with a simple structure.

The lubricant pressing member 153 includes an elastic body such as a spring, and presses the solid lubricant 155 against the lubricant applier 152 by applying a force in a range from about 1 N to about 4 N to the solid lubricant 155, so as to cause the lubricant applier 152 to scrape the solid lubricant 155.

A width of the solid lubricant 155 is greater than a width of a toner image formed on the intermediate transfer belt 10, and therefore is not smaller than about 304 mm. A width of the lubricant applier 152 is greater than the width of the solid lubricant 155 to scrape the solid lubricant 155 uniformly in a width direction of the solid lubricant 155 (e.g., an axial direction of the tension roller 13).

The image forming apparatus P1 uses polymerization toner produced by a polymerization method. Toner particles used in the image forming apparatus P1 have a shape factor SF-1 in a range from about 100 to about 180 and a shape factor SF-2 in a range from about 100 to about 180.

Figure 5:
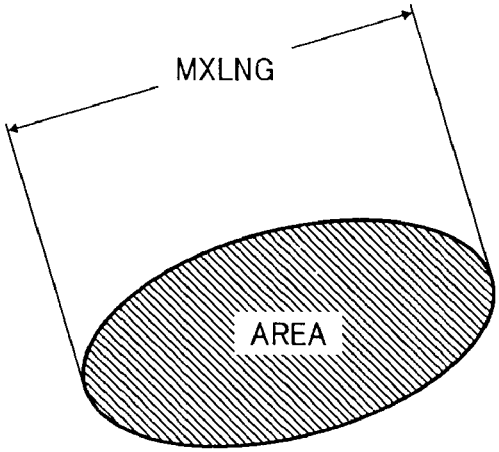
FIG. 5 is a diagram illustrating a typical shape of a toner particle having a shape factor SF-1 used in the image forming apparatus shown in FIG. 1.

FIG. 5 illustrates a typical shape of a toner particle having the shape factor SF-1. The shape factor SF-1 indicates a degree of roundness of a toner particle and is represented by a formula 1 below. The shape factor SF-1 (i.e., S in the formula 1) of the toner particle is calculated by squaring a maximum length MXLNG (i.e., M in the formula 1) of the toner particle projected on a two-dimensional plane, dividing the squared value by an area AREA (i.e., A in the formula 1) of the projected toner particle, and multiplying the divided value by 100π/4. When the shape factor SF-1 is 100, the toner particle has a spherical shape. The greater the shape factor SF-1 of the toner particle is, the more amorphous shape the toner particle has.

$$S=(M^2/A)\times(100\pi/4) \qquad \text{Formula 1}$$

Figure 6:
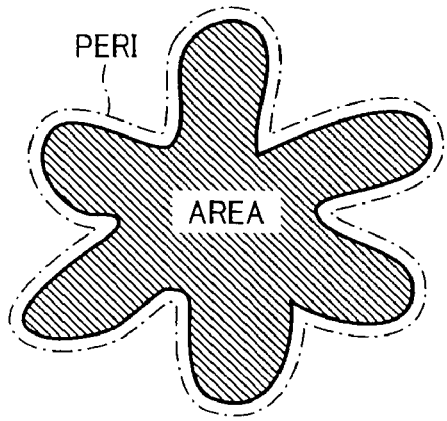
FIG. 6 is a diagram illustrating a typical shape of a toner particle having a shape factor SF-2 used in the image forming apparatus shown in FIG. 1.

FIG. 6 illustrates a typical shape of a toner particle having the shape factor SF-2. The shape factor SF-2 indicates a degree of concavo-convexity of the toner particle and is represented by a formula 2 below. The shape factor SF-2 (i.e., F in the formula 2) of the toner particle is calculated by squaring a peripheral length PERI (i.e., P in the formula 2) of the toner particle projected on a two-dimensional plane, dividing the squared value by an area AREA (i.e., A in the formula 2) of the projected toner particle, and multiplying the divided value by 100/4π. When the shape factor SF-2 is 100, a surface of the toner particle has no concavity and convexity. The greater the shape factor SF-2 of the toner particle is, the more roughened surface the toner particle has.

$$F=(P^2/A)\times(100/4\pi) \qquad \text{Formula 2}$$

The shape factors SF-1 and SF-2 of toner particles were determined by photographing the toner particles with a scanning electron microscope S-800 available from Hitachi, Ltd. and analyzing the photographed images with an image analyzer LUZEX3 available from NIRECO Corporation.

When toner particles have a sphere-like shape, the toner particles point-contact with each other. The toner particles also point-contact the surfaces of the photoconductors 1Y, 1M, 1C, and 1K depicted in FIG. 1. An attracting force between the toner particles becomes weaker. As a result, a fluidity of the toner particles becomes greater. An attracting force between the toner particles and the photoconductors 1Y, 1M, 1C, and 1K also becomes weaker. As a result, the toner particles can be transferred from the photoconductors 1Y, 1M, 1C, and 1K onto the intermediate transfer belt 10 depicted in FIG. 1 at an increased transfer rate. When the shape factor SF-1 or the shape factor SF-2 exceeds 180, the transfer rate decreases. Further, when the toner particles are adhered to the intermediate transfer belt 10, the belt cleaning unit 19 depicted in FIG. 4 may not remove the toner particles from the intermediate transfer belt 10 properly.

The toner particles may preferably have a volume average particle size in a range from about 4 μm to about 10 μm. When the toner particles have a volume average particle size smaller than the above-described range, the toner particles may cause background soiling when latent images formed on the photoconductors 1Y, 1M, 1C, and 1K are developed into toner images, respectively. Further, the flowability of the toner particles may deteriorate and the toner particles may agglomerate easily, resulting in white spots on the toner image. By contrast, when the toner particles have a volume average particle size greater than the above-described range, the toner particles may spatter on a transfer sheet and a resolution of the toner image may deteriorate. Accordingly, the image forming apparatus P1 cannot form a high-resolution image. According to this exemplary embodiment, the toner particles have a volume average particle size of about 6.5 μm.

Figure 7:
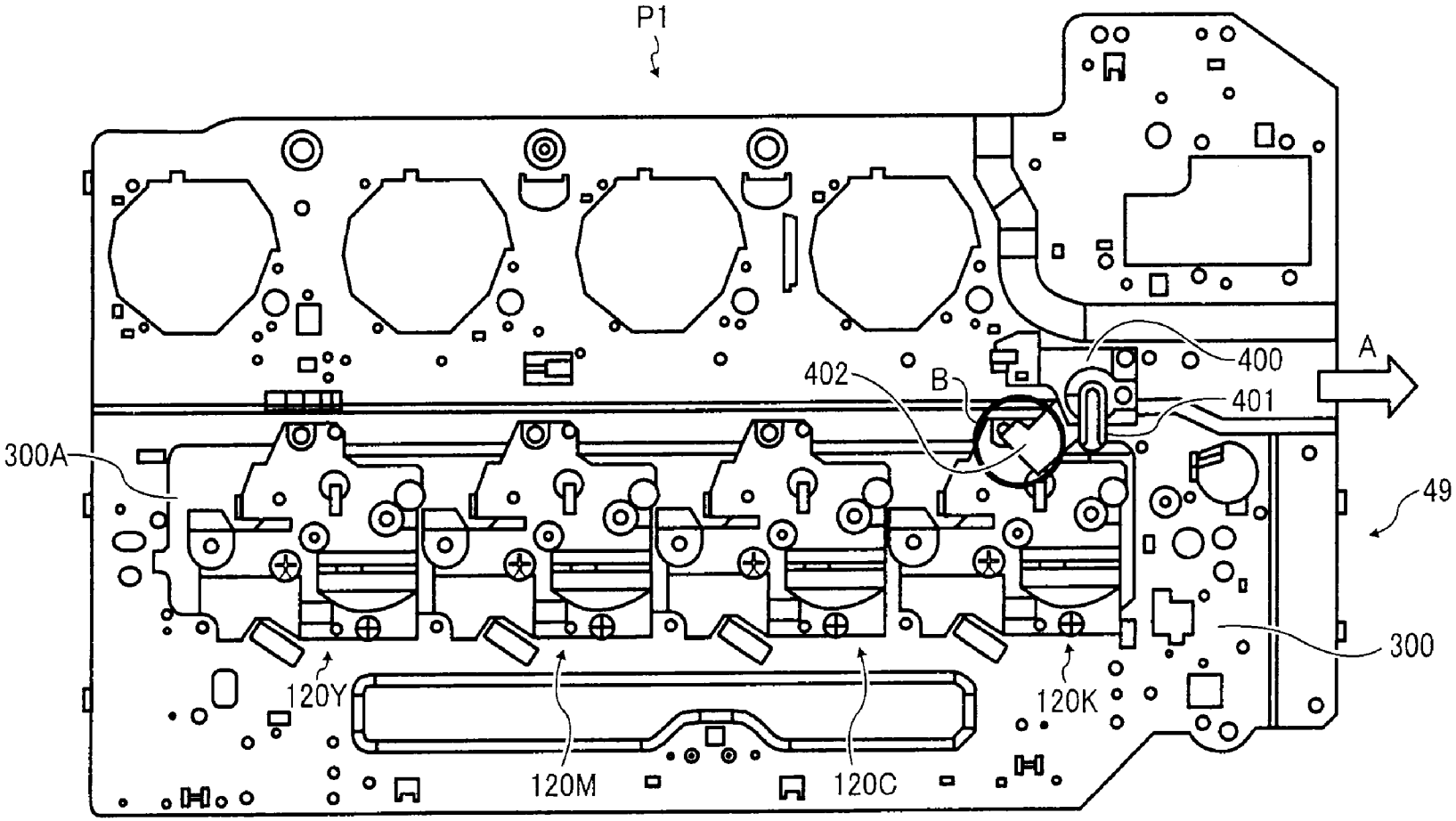
FIG. 7 is an enlarged front view of the image forming apparatus shown in FIG. 1.

FIG. 7 is an enlarged front view of the image forming apparatus P1. As illustrated in FIG. 7, the image forming apparatus P1 further includes a lever device 400. The lever device 400 includes a lever 401 and a shutter 402. The housing 49 includes a front housing panel 300. The front housing panel 300 includes an opening 300A.

The image forming units 120Y, 120M, 120C, and 120K including the photoconductors 1Y, 1M, 1C, and 1K depicted in FIG. 1, respectively, are detachably attached to the image forming apparatus P1 from a front side of the image forming apparatus P1 through the opening 300A provided in the front housing panel 300. Specifically, the opening 300A, serving as a first opening, is provided in the front housing panel 300, serving as a first housing panel, at a position opposing the image forming units 120Y, 120M, 120C, and 120K in such a manner that the image forming units 120Y, 120M, 120C, and 120K pass through the opening 300A of the front housing panel 300 when the image forming units 120Y, 120M, 120C, and 120K are attached to and detached from the image forming apparatus P1.

On the other hand, as illustrated in FIG. 3, when the side outer cover 45 is opened with respect to the image forming apparatus P1, the intermediate transfer unit 51 is attached to and detached from the image forming apparatus P1 from one side (e.g., a right side in FIG. 3) of the image forming apparatus P1 exposing the inside of the image forming apparatus P1. Specifically, the intermediate transfer unit 51, serving as a belt unit, is attached to and detached from the image forming apparatus P1 through the opening 301A, serving as a second opening, provided in the side housing panel 301, serving as a second housing panel, provided on the right side of the image forming apparatus P1. A user can insert and remove the intermediate transfer unit 51 through the opening 301A of the side housing panel 301 to attach and detach the intermediate transfer unit 51 to and from the image forming apparatus P1. Further, the user can remove a jammed transfer sheet through the opening 301A of the side housing panel 301. In order to detach the intermediate transfer unit 51 from the image forming apparatus P1 through the opening 301A of the side housing panel 301, the user pulls the intermediate transfer unit 51 in a direction A as illustrated in FIGS. 3 and 7. By contrast, in order to attach the intermediate transfer unit 51 to the image forming apparatus P1, the user pushes the intermediate transfer unit 51 in a direction opposite to the direction A.

Figure 8:
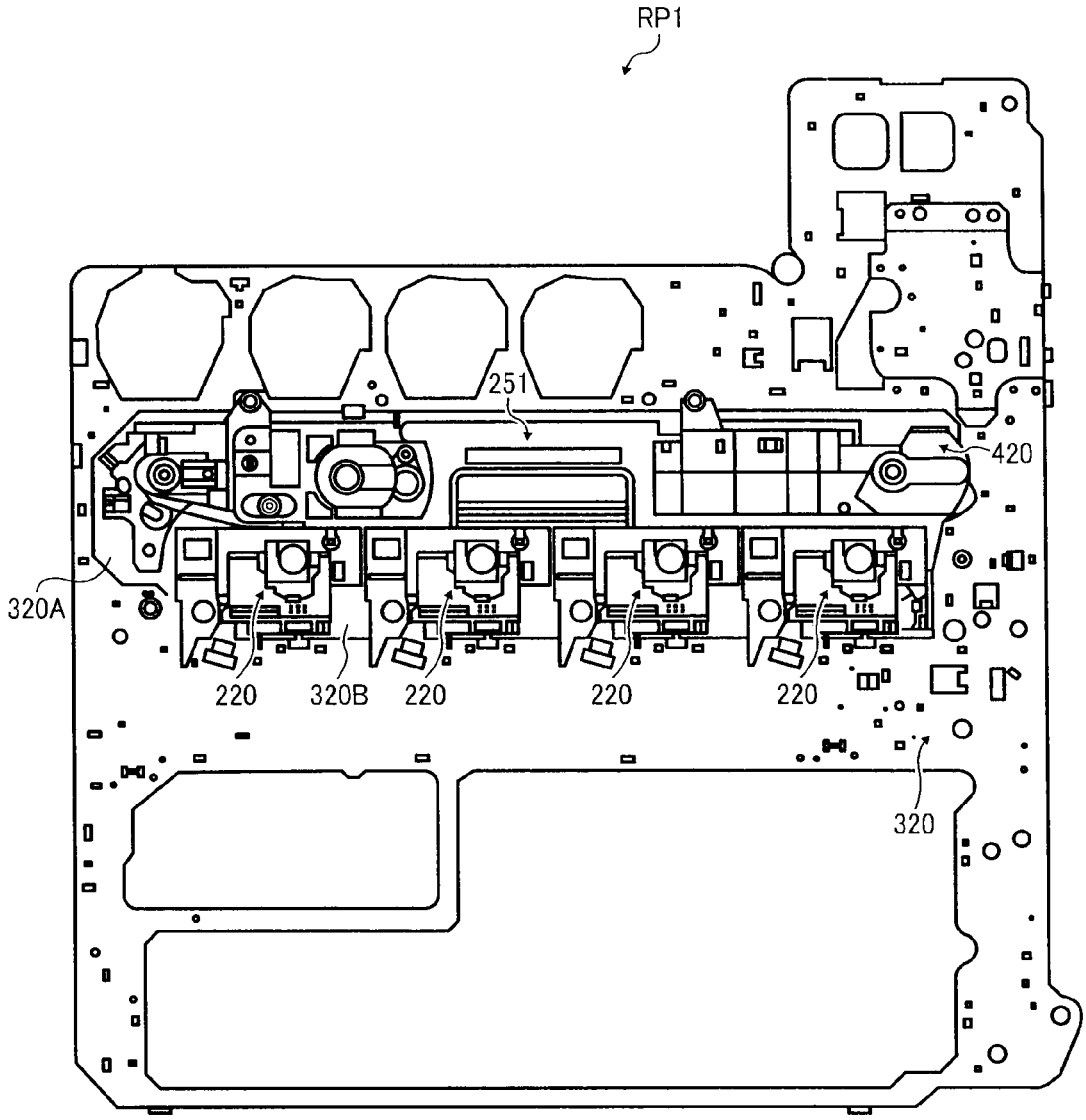
FIG. 8 is a schematic front view of a reference image forming apparatus.

Referring to FIG. 8, the following describes a reference image forming apparatus RP1. FIG. 8 is a schematic front view of the reference image forming apparatus RP1. As illustrated in FIG. 8, the reference image forming apparatus RP1 includes image forming units 220, an intermediate transfer unit 251, a front housing panel 320, and a lever device 420. The front housing panel 320 includes openings 320A and 320B. The other elements of the reference image forming apparatus RP1 are equivalent to the elements of the image forming apparatus P1 depicted in FIG. 1. The intermediate transfer unit 251 is attached to and detached from a front side of the reference image forming apparatus RP1.

Conventionally, the intermediate transfer unit 251 is attached to and detached from the reference image forming apparatus RP1 in a direction identical with a direction in which the image forming units 220 are attached to and detached from the reference image forming apparatus RP1.

In the reference image forming apparatus RP1 in which the intermediate transfer unit 251 and the image forming units 220 are attached to and detached from the reference image forming apparatus RP1 in the identical direction from the front side of the reference image forming apparatus RP1, for example, the large opening 320A is provided in the front housing panel 320 at a position above the image forming units 220 so that the intermediate transfer unit 251 is inserted into and removed from the reference image forming apparatus RP1 through the large opening 320A of the front housing panel 320. Further, another opening 320B is provided in the front housing panel 320 at a position below the intermediate transfer unit 251 so that the image forming units 220 are inserted into and removed from the reference image forming apparatus RP1 through the opening 320B of the front housing panel 320.

In other words, the intermediate transfer unit 251 and the image forming units 220 are inserted into the reference image forming apparatus RP1 in the identical direction from the front side to a rear side of the reference image forming apparatus RP1 and removed from the reference image forming apparatus RP1 in the identical direction from the rear side to the front side of the reference image forming apparatus RP1 through the openings 320A and 320B provided in the front housing panel 320. Accordingly, the opening 320B through which the image forming units 220 pass and the large opening 320A through which the intermediate transfer unit 251 passes decrease strength of the front housing panel 320 substantially.

To address this, in the image forming apparatus P1 depicted in FIG. 3, the intermediate transfer unit 51 is attached to and detached from the image forming apparatus P1 not from the front side of the image forming apparatus P1 but from the right side of the image forming apparatus P1. Therefore, a large opening equivalent to the opening 320A depicted in FIG. 8 through which the intermediate transfer unit 251 passes is not provided in the front housing panel 300 of the image forming apparatus P1 depicted in FIG. 7, suppressing decrease in strength of the front housing panel 300.

As illustrated in FIG. 1, when the image forming units 120Y, 120M, 120C, and 120K including the photoconductors 1Y, 1M, 1C, and 1K, respectively, and the intermediate transfer unit 51 are attached to and detached from the image forming apparatus P1 in a state in which the photoconductors 1Y, 1M, 1C, and 1K and the first transfer rollers 11Y, 11M, 11C, and 11K sandwich the intermediate transfer belt 10, respectively, the surfaces of the photoconductors 1Y, 1M, 1C, and 1K slide over the surface of the intermediate transfer belt 10, damaging the surfaces of the photoconductors 1Y, 1M, 1C, and 1K and the surface of the intermediate transfer belt 10. Consequently, the photoconductors 1Y, 1M, 1C, and 1K and the intermediate transfer belt 10 deteriorate quickly.

To address this, the lever device 400 depicted in FIG. 7 is provided on the intermediate transfer unit 51. Before the user attaches and detaches the intermediate transfer unit 51 to and from the image forming apparatus P1, the user operates the lever device 400 to separate the first transfer rollers 11Y, 11M, 11C, and 11K from the photoconductors 1Y, 1M, 1C, and 1K, respectively. When the first transfer rollers 11Y, 11M, 11C, and 11K separate from the photoconductors 1Y, 1M, 1C, and 1K, respectively, the surfaces of the photoconductors 1Y, 1M, 1C, and 1K do not contact the surface of the intermediate transfer belt 10. Accordingly, when the image forming units 120Y, 120M, 120C, and 120K and the intermediate transfer unit 51 are attached to and detached from the image forming apparatus P1, the surfaces of the photoconductors 1Y, 1M, 1C, and 1K do not slide over the surface of the intermediate transfer belt 10, suppressing damage to the surfaces of the photoconductors 1Y, 1M, 1C, and 1K and the surface of the intermediate transfer belt 10.

In the reference image forming apparatus RP1 illustrated in FIG. 8, the lever device 420 is provided at one end of a support roller included in the intermediate transfer unit 251, which is equivalent to the support roller 14 depicted in FIG. 1, in an axial direction of the support roller. The intermediate transfer unit 251 is attached to and detached from the front side of the reference image forming apparatus RP1 through the opening 320A provided in the front housing panel 320, which opposes the intermediate transfer unit 251 in the axial direction of the support roller. Accordingly, the lever device 420 can be provided on the intermediate transfer unit 251 at the one end of the support roller in the axial direction of the support roller properly. However, in the image forming apparatus P1 depicted in FIG. 3 in which the intermediate transfer unit 51 is attached to and detached from the image forming apparatus P1 from the right side of the image forming apparatus P1, the front housing panel 300 depicted in FIG. 7 is not provided with an opening through which the intermediate transfer unit 51 passes. To address this, the front housing panel 300 may include an opening for preventing the lever device 400 from interfering with the front housing panel 300.

Figure 9:
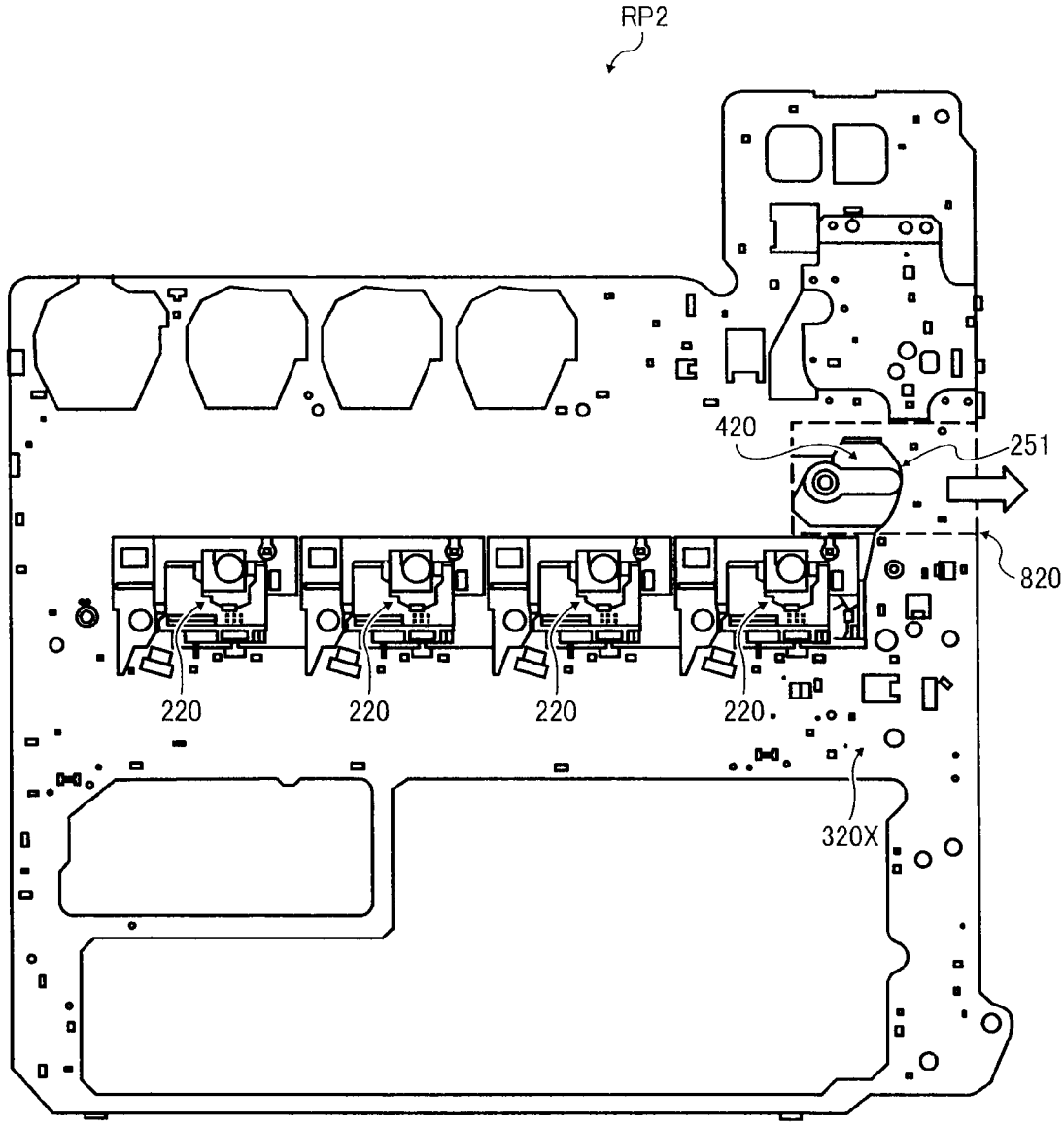
FIG. 9 is a schematic front view of another reference image forming apparatus.

FIG. 9 is a schematic front view of a reference image forming apparatus RP2 including such opening. As illustrated in FIG. 9, the reference image forming apparatus RP2 includes a front housing panel 320X. The front housing panel 320X includes an opening 820. The other elements of the reference image forming apparatus RP2 are equivalent to the elements of the reference image forming apparatus RP1 depicted in FIG. 8.

The opening 820 shown in a dotted line is provided in the front housing panel 320X so that the lever device 420 does not interfere with a portion of the front housing panel 320X shown in the dotted line. When the intermediate transfer unit 251 is attached to and detached from the reference image forming apparatus RP2, the lever device 420 moves in an area shown in the dotted line on the front housing panel 320X, which corresponds to the opening 820, without interfering with the front housing panel 320X. However, the opening 820 provided in the front housing panel 320X may decrease strength of the front housing panel 320X.

The strength of the housing panel, such as the front housing panel 300 depicted in FIG. 7, is an important factor in an image forming apparatus for forming a color toner image by superimposing yellow, magenta, cyan, and black toner images precisely, like the image forming apparatus P1 depicted in FIG. 1. The intermediate transfer unit 51 depicted in FIG. 1 needs to be located at a proper position in the image forming apparatus P1 to superimpose the yellow, magenta, cyan, and black toner images on the intermediate transfer belt 10 depicted in FIG. 1 precisely with the front housing panel 300 having increased strength.

As illustrated in FIG. 7, according to this exemplary embodiment, the lever device 400 is provided on the front housing panel 300, and moves the first transfer rollers 11Y, 11M, 11C, and 11K with respect to the photoconductors 1Y, 1M, 1C, and 1K, respectively, when the intermediate transfer unit 51 is attached to and detached from the image forming apparatus P1 depicted in FIG. 1. The full-color sub frame 36 (depicted in FIG. 2) supporting the first transfer rollers 11Y, 11M, and 11C for transferring the yellow, magenta, and cyan toner images, respectively, moves the first transfer rollers 11Y, 11M, and 11C with respect to the photoconductors 1Y, 1M, and 1C automatically. The lever device 400 moves the black sub frame 35 (depicted in FIG. 2) supporting the first transfer roller 11K for transferring the black toner image so that the black sub frame 35 moves the first transfer roller 11K with respect to the photoconductor 1K.

Thus, when the lever device 400 is provided not on the intermediate transfer unit 51 but on the front housing panel 300, the lever device 400 does not interfere with the front housing panel 300 even in a structure in which the intermediate transfer unit 51 is attached to and detached from the image forming apparatus P1 from the right side of the image forming apparatus P1. Further, an opening equivalent to the opening 820 depicted in FIG. 9 is not provided in the front housing panel 300 to prevent the lever device 400 from interfering with the front housing panel 300, suppressing decrease in strength of the front housing panel 300.

Even with the structure in which the lever device 400 moves the first transfer rollers 11Y, 11M, 11C, and 11K with respect to the photoconductors 1Y, 1M, 1C, and 1K, respectively, the user may accidentally attach and detach the image forming units 120Y, 120M, 120C, and 120K including the photoconductors 1Y, 1M, 1C, and 1K, respectively, and the intermediate transfer unit 51 depicted in FIG. 1 without separating the first transfer rollers 11Y, 11M, 11C, and 11K from the photoconductors 1Y, 1M, 1C, and 1K, respectively. In other words, with the structure in which the lever device 400 moves the first transfer rollers 11Y, 11M, 11C, and 11K with respect to the photoconductors 1Y, 1M, 1C, and 1K, respectively, the user may accidentally attach and detach the image forming units 120Y, 120M, 120C, and 120K and the intermediate transfer unit 51 while the photoconductors 1Y, 1M, 1C, and 1K and the first transfer rollers 11Y, 11M, 11C, and 11K sandwich the intermediate transfer belt 10. Accordingly, the surfaces of the photoconductors 1Y, 1M, 1C, and 1K and the surface of the intermediate transfer belt 10 may be damaged.

Figure 10:
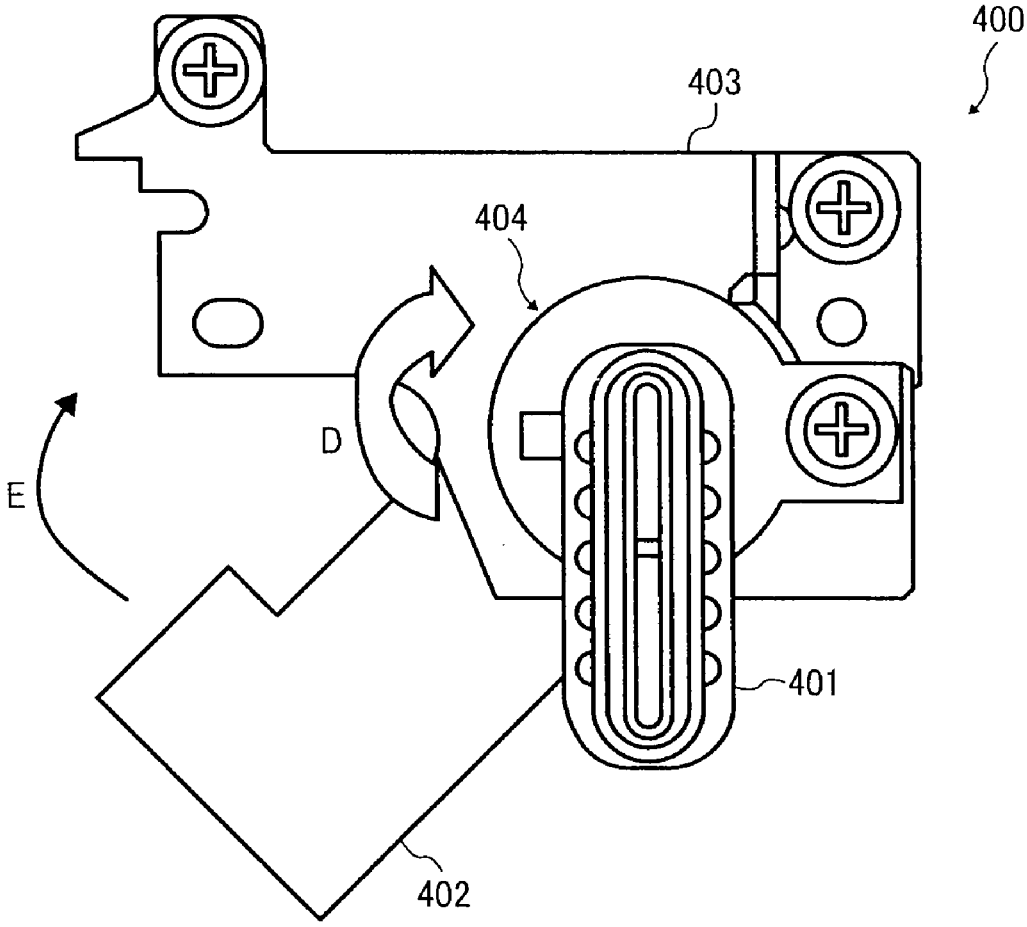
FIG. 10 is a sectional view of a lever device included in the image forming apparatus shown in FIG. 7.

FIG. 10 is a sectional view of the lever device 400. As illustrated in FIG. 10, the lever device 400 further includes a support bracket 403 and a lever bearing 404.

The support bracket 403 supports the lever bearing 404 and the shutter 402. The lever bearing 404 supports the lever 401.

The lever 401 is rotatable in a direction D. When the lever 401 rotates in the direction D, the shutter 402 rotates in a direction E in accordance with the rotation of the lever 401.

When the lever 401 is at a position illustrated in FIG. 7 at which a head of the lever 401, that is, one end of the lever 401 opposite to a rotation axis of the lever 401, faces down, the first transfer rollers 11Y, 11M, 11C, and 11K are pressed against the photoconductors 1Y, 1M, 1C, and 1K via the intermediate transfer belt 10, respectively, as illustrated in FIG. 1. When the first transfer rollers 11Y, 11M, 11C, and 11K are pressed against the photoconductors 1Y, 1M, 1C, and 1K, respectively, the shutter 402 covers or blocks a part of the image forming unit 120K in an attach-detach path extending in an attach-detach direction through which the image forming unit 120K is attached to and detached from the image forming apparatus P1. Thus, even when the user tries to remove the image forming unit 120K from the image forming apparatus P1, the shutter 402 contacts a front wall (e.g., a front side) of the image forming unit 120K in an area B depicted in FIG. 7. Accordingly, the shutter 402, serving as a regulating member, regulates movement of the image forming unit 120K in the attach-detach direction. In other words, when the first transfer rollers 11Y, 11M, 11C, and 11K are pressed against the photoconductors 1Y, 1M, 1C, and 1K, respectively, the shutter 402 prohibits the user from inserting or removing the image forming units 120Y, 120M, 120C, and/or 120K into or from the image forming apparatus P1.

When the user rotates the lever 401 in the direction D depicted in FIG. 10 to separate the first transfer rollers 11Y, 11M, 11C, and 11K from the photoconductors 1Y, 1M, 1C, and 1K, respectively, the shutter 402 rotates in the direction E depicted in FIG. 10, and therefore does not cover or block the front wall of the image forming unit 120K in the attach-detach path extending in the attach-detach direction in which the image forming unit 120K is attached to and detached from the image forming apparatus P1. Accordingly, when the first transfer rollers 11Y, 11M, 11C, and 11K separate from the photoconductors 1Y, 1M, 1C, and 1K, respectively, the shutter 402 does not regulate movement of the image forming unit 120K in the attach-detach direction. In other words, when the first transfer rollers 11Y, 11M, 11C, and 11K separate from the photoconductors 1Y, 1M, 1C, and 1K, respectively, the shutter 402 allows the user to insert or remove the image forming units 120Y, 120M, 120C, and/or 120K into or from the image forming apparatus P1.

Figure 11:
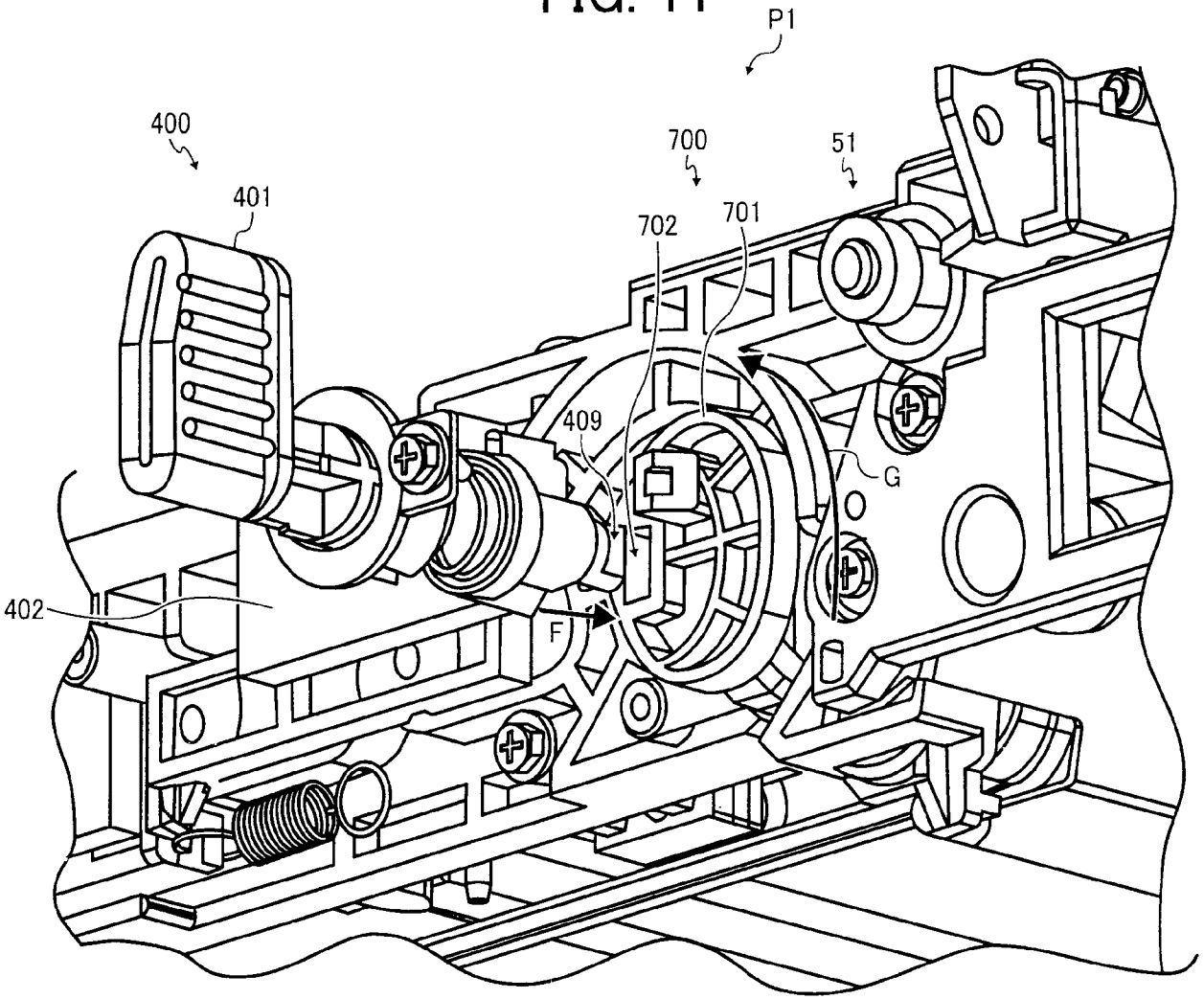
FIG. 11 is a perspective view of the lever device shown in FIG. 10 and the intermediate transfer unit shown in FIG. 2.

Referring to FIG. 11, the following describes engagement of the lever device 400 with the intermediate transfer unit 51. FIG. 11 is a perspective view of the lever device 400 and the intermediate transfer unit 51. As illustrated in FIG. 11, the image forming apparatus P1 further includes a moving mechanism 700. The moving mechanism 700 includes a moving cam 701. The moving cam 701 includes an engagement hole 702. The lever device 400 further includes an engagement member 409.

In the intermediate transfer unit 51 illustrated in FIG. 11, the first transfer rollers 11Y, 11M, 11C, and 11K separate from the photoconductors 1Y, 1M, 1C, and 1K, respectively, and therefore the lever 401 is at a separation position corresponding to a state in which the first transfer rollers 11Y, 11M, 11C, and 11K separate from the photoconductors 1Y, 1M, 1C, and 1K, respectively. The moving mechanism 700 is provided in the intermediate transfer unit 51. The moving cam 701 of the moving mechanism 700 engages the lever 401 to move the first transfer rollers 11Y, 11M, 11C, and 11K between a contact position at which the first transfer rollers 11Y, 11M, 11C, and 11K are pressed against the photoconductors 1Y, 1M, 1C, and 1K, respectively, and a separation position at which the first transfer rollers 11Y, 11M, 11C, and 11K separate from the photoconductors 1Y, 1M, 1C, and 1K, respectively, via the black sub frame 35 and the full-color sub frame 36 depicted in FIG. 2 in accordance with rotation of the lever 401. In FIG. 11, the moving cam 701 does not engage the lever 401.

In order to press the first transfer rollers 11Y, 11M, 11C, and 11K against the photoconductors 1Y, 1M, 1C, and 1K, respectively, the user catches and moves the lever 401 so that the engagement member 409 mounted on the lever 401 moves in a direction F corresponding to an axial direction of the support roller 14 depicted in FIG. 1. Accordingly, the engagement member 409 mounted on the lever 401 is inserted into the engagement hole 702 of the moving cam 701 provided in the intermediate transfer unit 51. After the engagement hole 702 serving as a first engagement member engages the engagement member 409 serving as a second engagement member, the user moves the lever 401 counterclockwise in FIG. 11 in a direction opposite to the direction D depicted in FIG. 10. Accordingly, the moving cam 701 serving as a moving member rotates in a direction G, and the first transfer rollers 11Y, 11M, 11C, and 11K are pressed against the photoconductors 1Y, 1M, 1C, and 1K, respectively, via the intermediate transfer belt 10 depicted in FIG. 1. Namely, when the first transfer rollers 11Y, 11M, 11C, and 11K are pressed against the photoconductors 1Y, 1M, 1C, and 1K, respectively, the engagement member 409 mounted on the lever 401 engages the engagement hole 702 of the moving cam 701 provided in the intermediate transfer unit 51. Thus, the engagement member 409 mounted on the lever 401 regulates movement of the intermediate transfer unit 51 in an attach-detach direction in which the intermediate transfer unit 51 is attached to and detached from the image forming apparatus P1. Consequently, the user cannot remove the intermediate transfer unit 51 from the image forming apparatus P1.

Figure 12:
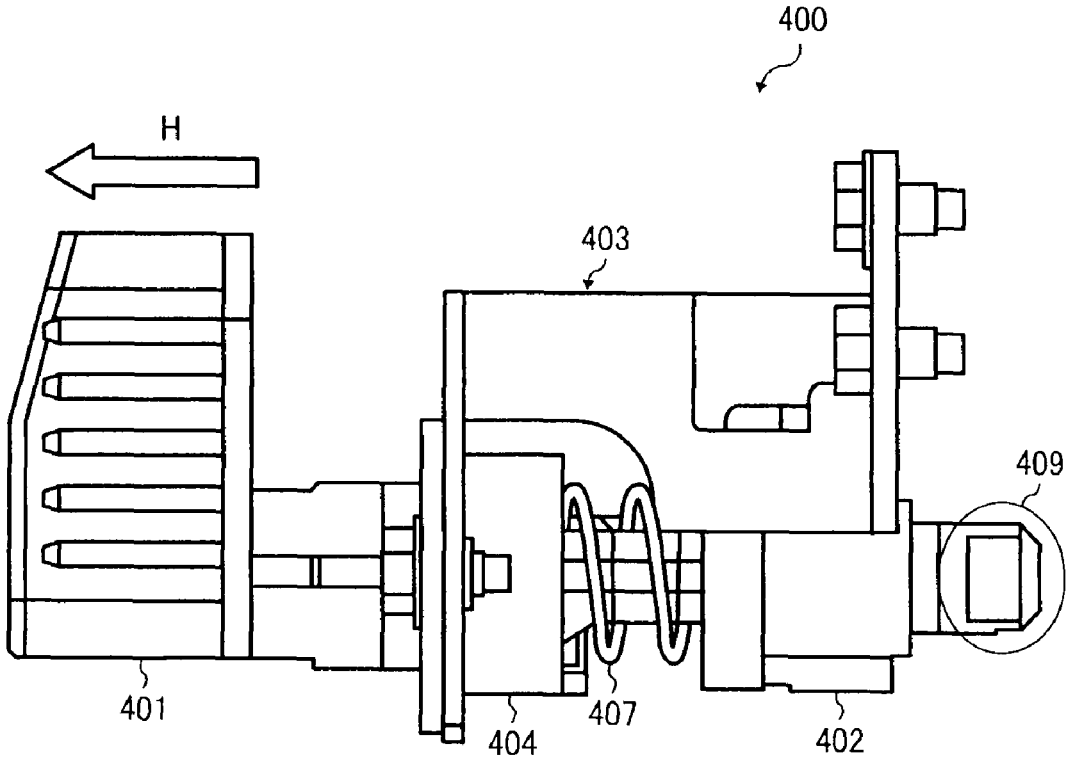
FIG. 12 is a schematic side view of the lever device shown in FIG. 10.

FIG. 12 is a schematic side view of the lever device 400. As illustrated in FIG. 12, the lever device 400 further includes a lever spring 407.

When the lever 401 rotates in the direction D depicted in FIG. 10 and the first transfer rollers 11Y, 11M, 11C, and 11K separate from the photoconductors 1Y, 1M, 1C, and 1K, respectively, the lever spring 407 applies a force to the lever 401 to move the lever 401 in a direction H toward the front side of the image forming apparatus P1. When the lever 401 moves in the direction H, the engagement member 409 engaging the intermediate transfer unit 51 depicted in FIG. 11 disengages the intermediate transfer unit 51. Accordingly, the user can remove the intermediate transfer unit 51 from the image forming apparatus P1. In other words, according to this exemplary embodiment, the user can remove the intermediate transfer unit 51 from the image forming apparatus P1 when the first transfer rollers 11Y, 11M, 11C, and 11K separate from the photoconductors 1Y, 1M, 1C, and 1K, respectively.

When the user tries to reattach the intermediate transfer unit 51 to the image forming apparatus P1, the engagement member 409 moves in a direction opposite to the direction H when the lever 401 moves to a contact position corresponding to a state in which the first transfer rollers 11Y, 11M, 11C, and 11K are pressed against the photoconductors 1Y, 1M, 1C, and 1K, respectively. Namely, the engagement member 409 is positioned in the attach-detach path in which the intermediate transfer unit 51 is attached to and detached from the image forming apparatus P1. Accordingly, even when the user tries to attach the intermediate transfer unit 51 to the image forming apparatus P1, the engagement member 409 interferes with the intermediate transfer unit 51 in the attach-detach path, and the engagement member 409 regulates movement of the intermediate transfer unit 51 in the attach-detach direction in which the intermediate transfer unit 51 is attached to and detached from the image forming apparatus P1. Consequently, the user cannot attach the intermediate transfer unit 51 to the image forming apparatus P1.

As described above, the lever 401 and the shutter 402 of the lever device 400 regulate attachment and detachment of the image forming units 120Y, 120M, 120C, and 120K and the intermediate transfer unit 51 with respect to the image forming apparatus P1 depicted in FIG. 1. Accordingly, the image forming units 120Y, 120M, 120C, and 120K and the intermediate transfer unit 51 are not attached to and detached from the image forming apparatus P1 while the first transfer rollers 11Y, 11M, 11C, and 11K are pressed against the photoconductors 1Y, 1M, 1C, and 1K, respectively, via the intermediate transfer belt 10 depicted in FIG. 1. Consequently, the surfaces of the photoconductors 1Y, 1M, 1C, and 1K and the surface of the intermediate transfer belt 10 may not be damaged.

Figure 13:
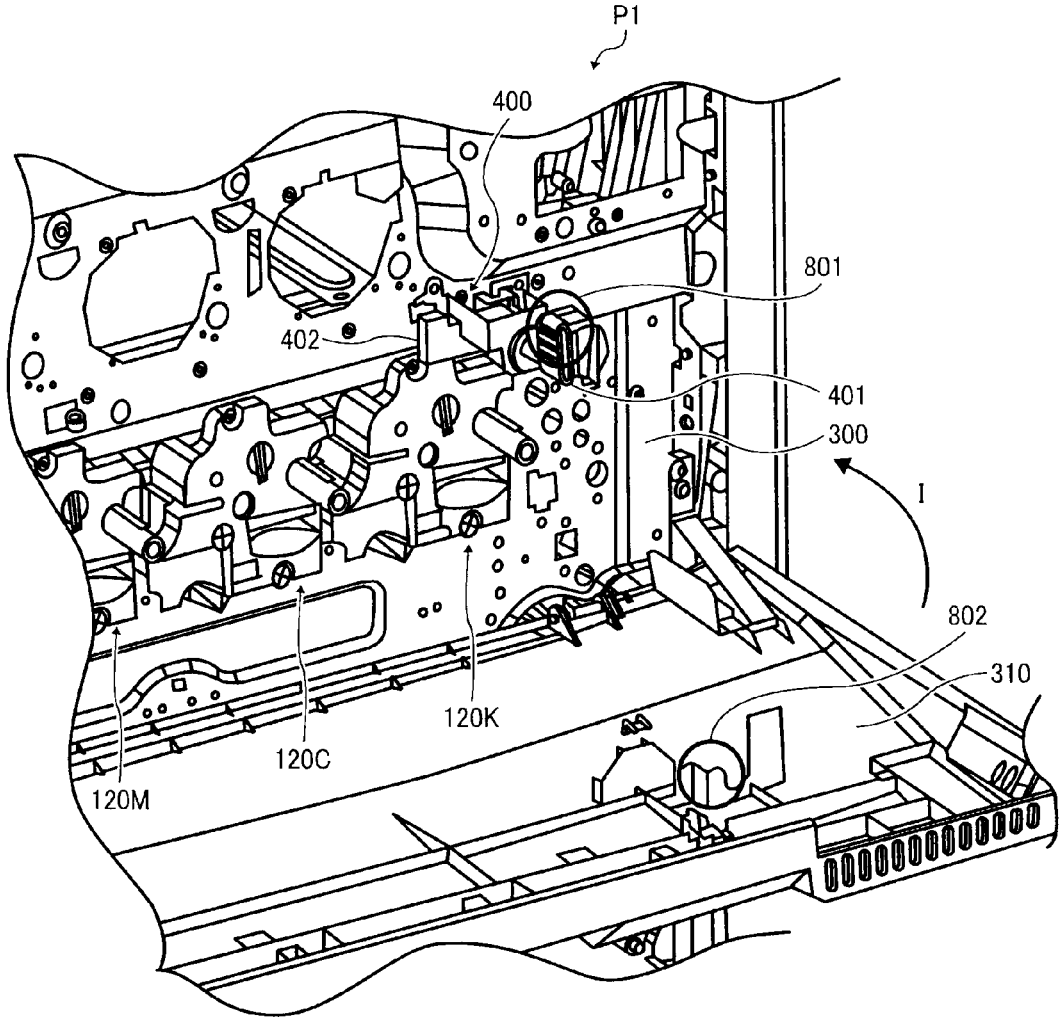
FIG. 13 is a perspective view of the image forming apparatus shown in FIG. 1 for explaining prevention of malfunction of the lever device shown in FIG. 10.

FIG. 13 is a perspective view of the image forming apparatus P1 for explaining prevention of malfunction of the lever device 400. As illustrated in FIG. 13, the image forming apparatus P1 further includes a front cover 310 and a protrusion 802. The lever 401 includes a head 801.

In FIG. 13, the lever device 400 does not regulate movement of the image forming units 120Y, 120M, 120C, and 120K and the intermediate transfer unit 51 depicted in FIG. 1 in the attach-detach directions in which the image forming units 120Y, 120M, 120C, and 120K and the intermediate transfer unit 51 are attached to and detached from the image forming apparatus P1, respectively. Namely, the image forming units 120Y, 120M, 120C, and 120K and the intermediate transfer unit 51 can be attached to and detached from the image forming apparatus P1.

When the lever 401 is at the attach-detach position corresponding to a state in which the image forming units 120Y, 120M, 120C, and 120K and the intermediate transfer unit 51 can be attached to and detached from the image forming apparatus P1, that is, when the lever 401 is at the separation position corresponding to the state in which the first transfer rollers 11Y, 11M, 11C, and 11K separate from the photoconductors 1Y, 1M, 1C, and 1K, respectively, the protrusion 802 provided on the front cover 310 interferes with the head 801 of the lever 401 when the user rotates the front cover 310 in a direction I to close the front cover 310 with respect to the image forming apparatus P1. Thus, the front cover 310 cannot be closed with respect to the image forming apparatus P1 properly.

When the front cover 310 is not closed with respect to the image forming apparatus P1, an interlock switch for detecting that the front cover 310 is closed with respect to the image forming apparatus P1 is not turned on. Accordingly, an electric circuit is not operable and therefore the entire image forming apparatus P1 is not operable. Namely, the lever device 400 can prevent a malfunction that the image forming apparatus P1 performs an image forming operation while the first transfer rollers 11Y, 11M, 11C, and 11K separate from the photoconductors 1Y, 1M, 1C, and 1K, respectively.

Figure 14:
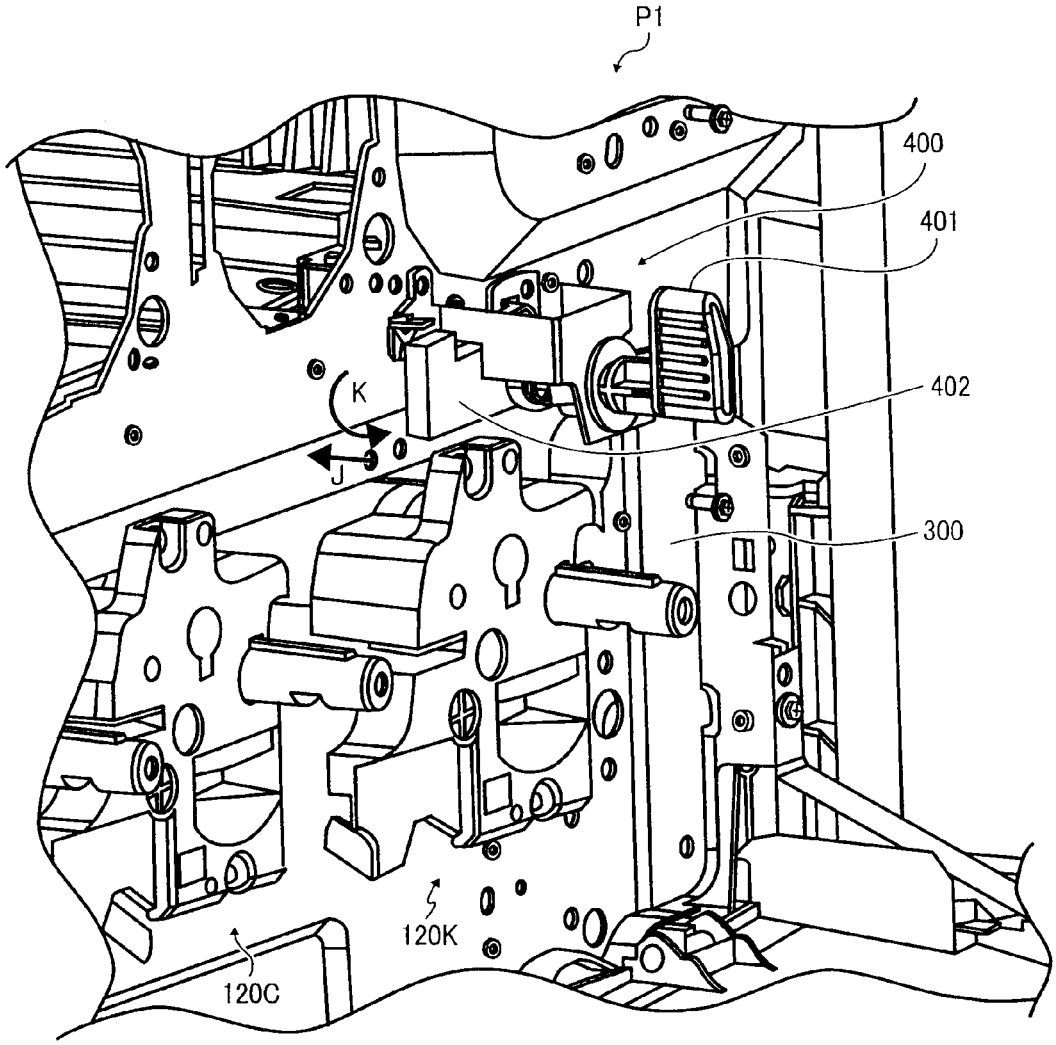
FIG. 14 is a front perspective view of an image forming unit included in the image forming apparatus shown in FIG. 1 and the lever device shown in FIG. 10.

FIG. 14 is a front perspective view of the image forming unit 120K and the lever device 400. In FIG. 14, the image forming unit 120K is not set in the image forming apparatus P1 properly. In other words, the image forming unit 120K does not move in a direction J further, and therefore is not inserted into a predetermined position inside the image forming apparatus P1. Consequently, the image forming unit 120K is not secured to the front housing panel 300 with a screw. When the user rotates the lever 401 counterclockwise in FIG. 14 in a direction opposite to the direction D depicted in FIG. 10 to press the first transfer rollers 11Y, 11M, 11C, and 11K against the photoconductors 1Y, 1M, 1C, and 1K, respectively, the shutter 402 rotates slightly in a direction K. However, the shutter 402 interferes with (e.g., strikes) the image forming unit 120K or the photoconductor 1K included in the image forming unit 120K, and does not rotate further in the direction K. Consequently, the user cannot rotate the lever 401 counterclockwise in FIG. 14 further. Thus, when the user cannot rotate the lever 401 further, the user notices that the image forming unit 120K is not set in the image forming apparatus P1 properly. Accordingly, the user may not cause the image forming apparatus P1 to perform an image forming operation while the image forming unit 120K is not set in the image forming apparatus P1 properly.

Even when the user does not notice or forgets that the image forming unit 120K is not set in the image forming apparatus P1 properly and accidentally tries to cause the image forming apparatus P1 to perform an image forming operation, the protrusion 802 mounted on the front cover 310 depicted in FIG. 13 interfering with the lever device 400 may prevent an operation error of the user to cause the image forming apparatus P1 to perform an image forming operation while the image forming unit 120K is not set in the image forming apparatus P1 properly, improving a fail-safe function for preventing the operation error of the user.

Figure 15:
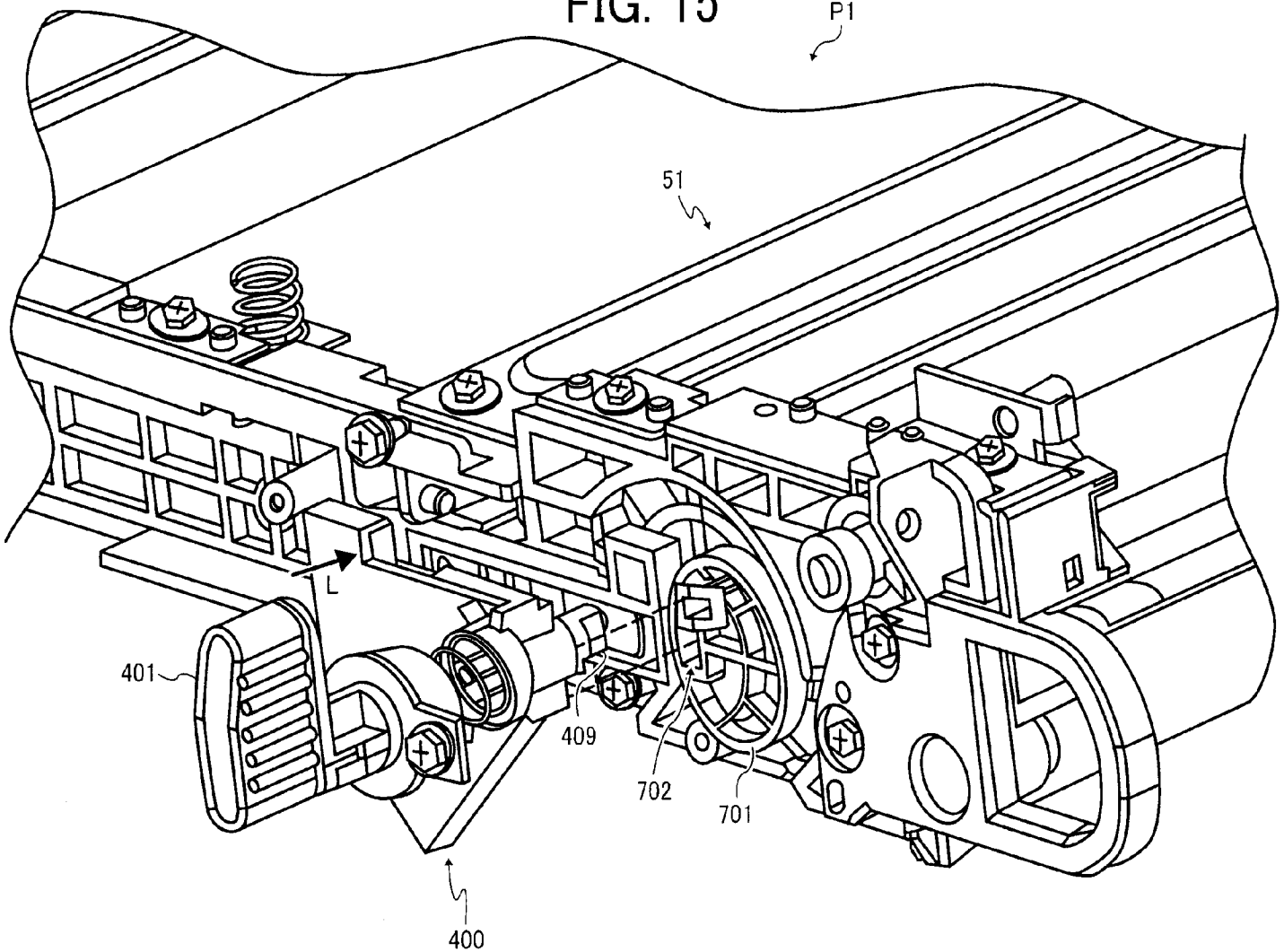
FIG. 15 is a front perspective view of the intermediate transfer unit shown in FIG. 2 and the lever device shown in FIG. 10.

FIG. 15 is a front perspective view of the intermediate transfer unit 51 and the lever device 400. When the intermediate transfer unit 51 is not set in the image forming apparatus P1 properly as illustrated in FIG. 15, the engagement member 409 mounted on the lever 401 is not provided coaxial with the engagement hole 702 provided in the moving cam 701, and therefore the engagement member 409 does not engage the engagement hole 702. Accordingly, the user cannot push the lever 401 in a direction L. The user cannot rotate the lever 401 unless the lever 401 moves in the direction L until the engagement member 409 mounted on the lever 401 engages the engagement hole 702 provided in the moving cam 701. When the user cannot rotate the lever 401, the user notices that the intermediate transfer unit 51 is not set in the image forming apparatus P1 properly. Accordingly, the user may not cause the image forming apparatus P1 to perform an image forming operation while the intermediate transfer unit 51 is not set in the image forming apparatus P1 properly.

Even when the user does not notice or forgets that the intermediate transfer unit 51 is not set in the image forming apparatus P1 properly and accidentally tries to cause the image forming apparatus P1 to perform an image forming operation, the protrusion 802 mounted on the front cover 310 depicted in FIG. 13 interfering with the lever device 400 may prevent an operation error of the user to cause the image forming apparatus P1 to perform an image forming operation while the intermediate transfer unit 51 is not set in the image forming apparatus P1 properly, improving a fail-safe function for preventing the operation error of the user.

Figure 16:
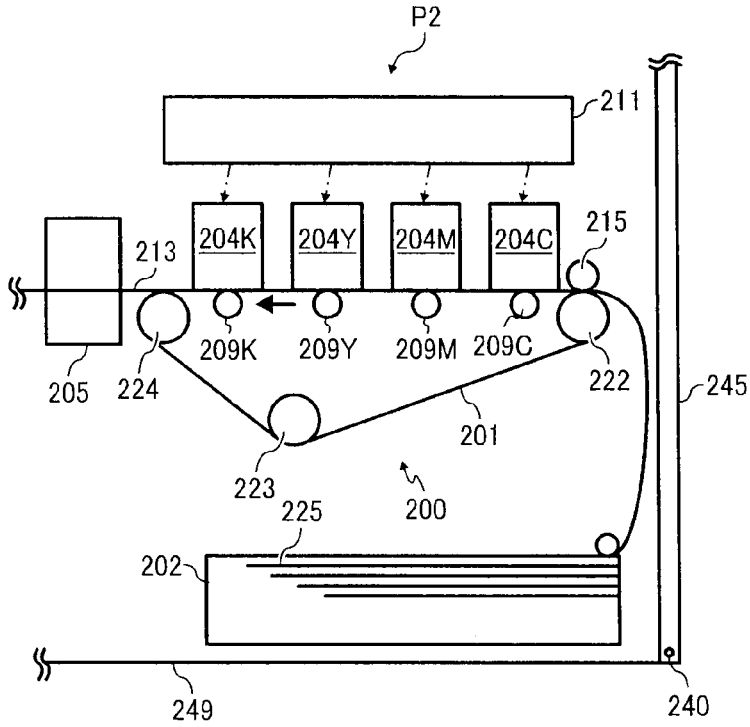
FIG. 16 is a schematic view of an image forming apparatus according to another exemplary embodiment of the present invention.

Referring to FIG. 16, the following describes an image forming apparatus P2 according to another exemplary embodiment. The image forming apparatus P2 functions as a tandem color image forming apparatus for forming a color image on a recording medium by electrophotography. FIG. 16 is a schematic view of the image forming apparatus P2. As illustrated in FIG. 16, the image forming apparatus P2 includes a sheet conveyor 200, a sheet supplier 202, photoconductor units 204C, 204M, 204Y, and 204K, a fixing device 205, an exposure device 211, a sheet conveyance path 213, a sheet attraction roller 215, a swing shaft 240, a side outer cover 245, and a housing 249.

The sheet conveyor 200 includes a transfer-conveyor belt 201, transfer rollers 209C, 209M, 209Y, and 209K, and support rollers 222, 223, and 224.

The sheet supplier 202 contains transfer sheets 225 serving as recording media or transfer materials. The sheet conveyance path 213 connects the sheet supplier 202 to an output portion. The photoconductor units 204C, 204M, 204Y, and 204K and the sheet conveyor 200 surround the sheet conveyance path 213.

In the sheet conveyor 200 serving as a belt unit, the photoconductor units 204C, 204M, 204Y, and 204K serve as image carriers for carrying cyan, magenta, yellow, and black toner images, respectively. The transfer-conveyor belt 201 is looped over a plurality of support rollers 222, 223, and 224 serving as a plurality of support members, and serves as a belt of a transfer sheet conveyance member for conveying a transfer sheet 225 sent from the sheet supplier 202. The transfer-conveyor belt 201 has a medium volume resistivity in a range from about $10^9$ Ω·cm to about $10^{12}$ Ω·cm.

The sheet attraction roller 215 is provided upstream from the photoconductor unit 204C in the sheet conveyance path 213 in a sheet conveyance direction in such a manner that the sheet attraction roller 215 opposes the support roller 222 via the transfer-conveyor belt 201 and the sheet conveyance path 213. The sheet attraction roller 215 serves as a charge applier for applying charge to the transfer-conveyor belt 201 to attract the transfer sheet 225 electrostatically.

The fixing device 205 is provided downstream from the photoconductor unit 204K in the sheet conveyance path 213 in the sheet conveyance direction.

Figure 17:
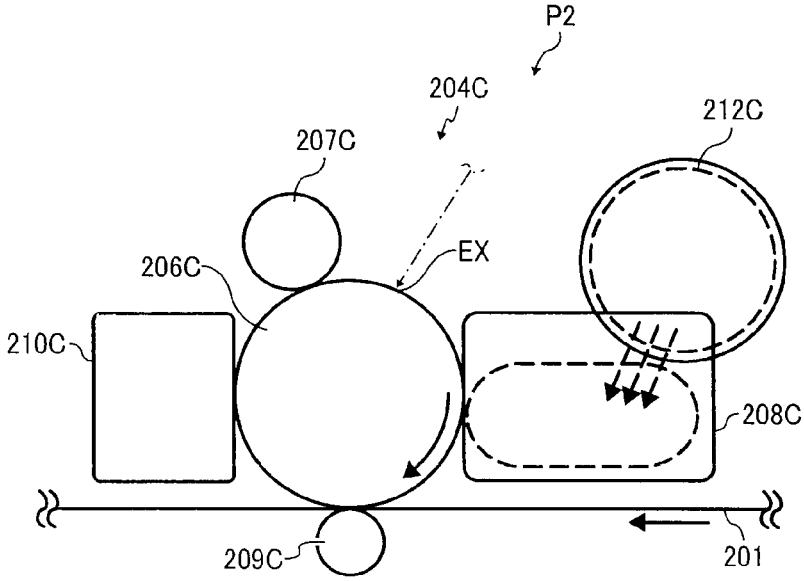
FIG. 17 is a sectional view of the image forming apparatus shown in FIG. 16.

The photoconductor units 204C, 204M, 204Y, and 204K form toner images in different colors, but have an identical structure and perform identical operations. Referring to FIG. 17, the following describes the structure and the operations of the photoconductor unit 204C for forming a cyan toner image. FIG. 17 is a sectional view of the image forming apparatus P2. As illustrated in FIG. 17, the image forming apparatus P2 further includes a toner container 212C. The photoconductor unit 204C includes a photoconductor 206C, a charger 207C, a development device 208C, and a cleaner 210C.

Since each of the photoconductor units 204M, 204Y, and 204K has the structure equivalent to the structure of the photoconductor unit 204C, illustration showing the structure of each of the photoconductor units 204M, 204Y, and 204K is omitted.

The photoconductor 206C serves as an image carrier for carrying an electrostatic latent image and a cyan toner image. The charger 207C, the development device 208C, the transfer roller 209C, and the cleaner 210C surround the photoconductor 206C in this order in a direction of rotation of the photoconductor 206C. An LED (light-emitting diode) array head of the exposure device 211 depicted in FIG. 16 opposes the photoconductor 206C at an exposure position EX provided on a surface of the photoconductor 206C between the charger 207C and the development device 208C. Light-emitting elements of the LED array head emit light onto the surface of the photoconductor 206C at the exposure position EX so that the surface of the photoconductor 206C is exposed to the light.

Referring to FIG. 17, the following describes an image forming operation for forming a cyan toner image in the photoconductor unit 204C. The charger 207C uniformly charges the surface of the photoconductor 206C to have a predetermined polarity. The light-emitting elements of the LED array head of the exposure device 211 depicted in FIG. 16 selectively emit light onto the charged surface of the photoconductor 206C at the exposure position EX. The light emitted on the surface of the photoconductor 206C generates a difference in charge potential level of the charged surface of the photoconductor 206C to form an electrostatic latent image on the surface of the photoconductor 206C. The development device 208C, serving as a toner image formation member, causes cyan toner particles having a predetermined charge to adhere to the electrostatic latent image to make the electrostatic latent image visible as a cyan toner image. The toner container 212C supplies cyan toner particles to the development device 208C as needed.

The transfer roller 209C, serving as a transfer member, attracts the cyan toner image by the difference in charge potential level of the charged surface of the photoconductor 206C to transfer the cyan toner image formed on the photoconductor 206C onto a transfer sheet 225 carried and conveyed on a surface of the transfer-conveyor belt 201. The cleaner 210C cleans the surface of the photoconductor 206C by scraping residual toner particles remaining on the surface of the photoconductor 206C after the transfer roller 209C transfers the cyan toner image formed on the surface of the photoconductor 206C onto the transfer sheet 225. Thus, the residual toner particles are removed from the surface of the photoconductor 206C and the photoconductor 206C becomes ready for a next image forming operation.

Similarly, magenta, yellow, and black toner images are formed by the photoconductor units 204M, 204Y, and 204K depicted in FIG. 16 and transferred onto the transfer sheet 225 bearing the cyan toner image in such a manner that the magenta, yellow, and black toner images are superimposed on the cyan toner image to form a color toner image on the transfer sheet 225. The transfer-conveyor belt 201 conveys the transfer sheet 225 bearing the color toner image to the fixing device 205 depicted in FIG. 16. The fixing device 205 applies heat and pressure to the transfer sheet 225 to fix the color toner image on the transfer sheet 225.

Figure 18:
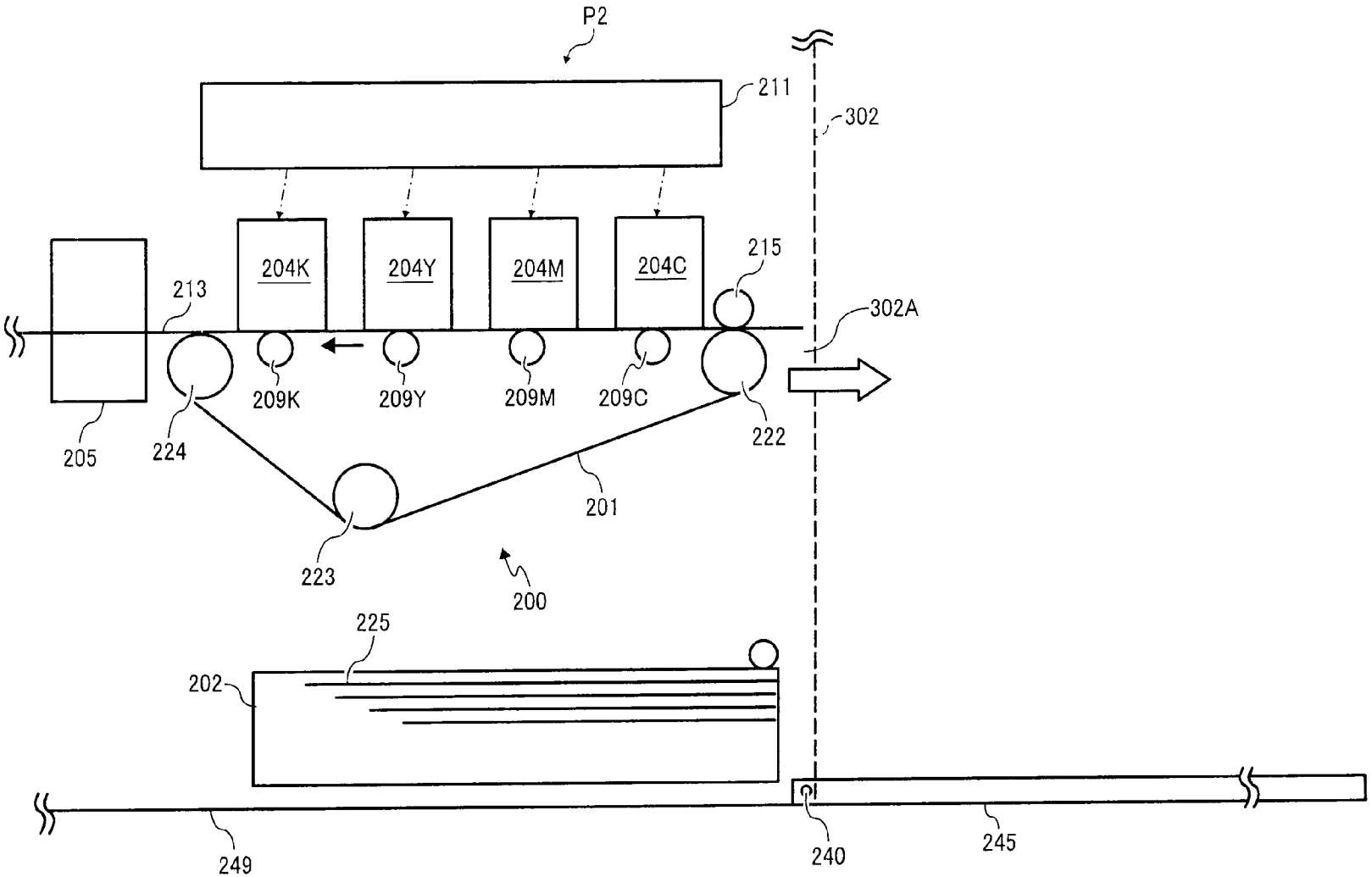
FIG. 18 is a schematic view of the image forming apparatus shown in FIG. 16 when a side outer cover included in the image forming apparatus is opened.

FIG. 18 is a schematic view of the image forming apparatus P2 when the side outer cover 245 is opened. As illustrated in FIG. 18, the housing 249 includes a side housing panel 302. The side housing panel 302 includes an opening 302A.

The side outer cover 245 serves as an open-close cover provided in one end of the image forming apparatus P2, and swings about the swing shaft 240 provided on the housing 249 of the image forming apparatus P2. When the user opens the side outer cover 245, the user can access a conveyance path for conveying a transfer sheet 225 in the image forming apparatus P2, such as the sheet conveyance path 213, to remove the transfer sheet 225 jammed inside the image forming apparatus P2. When the user closes the side outer cover 245 after removing the jammed transfer sheet 225, the image forming apparatus P2 resumes an image forming operation interrupted by the jammed transfer sheet 225.

Figure 19:
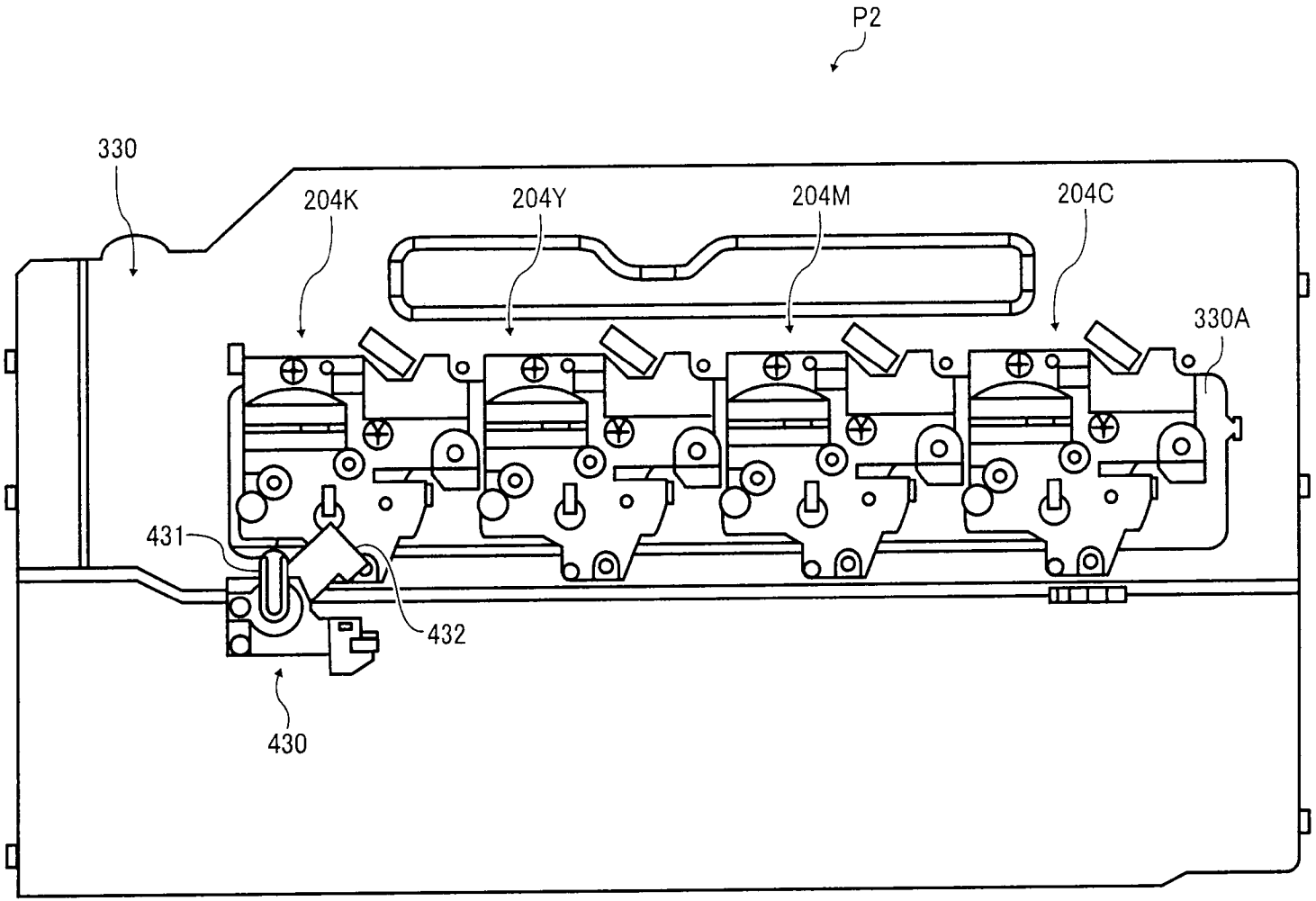
FIG. 19 is a front view of the image forming apparatus shown in FIG. 16.

FIG. 19 is a front view of the image forming apparatus P2. As illustrated in FIG. 19, the image forming apparatus P2 further includes a front housing panel 330 and a lever device 430. The front housing panel 330 includes an opening 330A. The lever device 430 includes a lever 431 and a shutter 432.

The photoconductor units 204C, 204M, 204Y, and 204K are attached to and detached from a front side of the image forming apparatus P2. The opening 330A, serving as a first opening, is provided in the front housing panel 330, serving as a first housing panel, at a position opposing the photoconductor units 204C, 204M, 204Y, and 204K so that the photoconductor units 204C, 204M, 204Y, and 204K pass through the opening 330A when the photoconductor units 204C, 204M, 204Y, and 204K are attached to and detached from the image forming apparatus P2.

As illustrated in FIG. 18, when the side outer cover 245 provided in one end (e.g., a right side in FIG. 18) of the image forming apparatus P2 is opened with respect to the image forming apparatus P2 and therefore an inside of the image forming apparatus P2 is exposed, the user can attach and detach the sheet conveyor 200 from the right side of the image forming apparatus P2. Specifically, the sheet conveyor 200 is attached to and detached from the image forming apparatus P2 through the opening 302A serving as a second opening provided in the side housing panel 302 serving as a second housing panel.

Like in the image forming apparatus P1 depicted in FIG. 13, the user operates the lever device 430 depicted in FIG. 19 to move the transfer rollers 209C, 209M, 209Y, and 209K depicted in FIG. 16 with respect to the photoconductors 206C, 206M, 206Y, and 209K depicted in FIG. 17, respectively, when the user attaches and detaches the sheet conveyor 200 depicted in FIG. 16 to and from the image forming apparatus P2.

As illustrated in FIG. 19, the lever device 430 is provided on the front housing panel 330. Accordingly, even when the sheet conveyor 200 is attached to and detached from the image forming apparatus P2 through the right side of the image forming apparatus P2 in a direction perpendicular to an axial direction of the support rollers 222 to 224 depicted in FIG. 18, an opening for preventing the lever device 430 from interfering with the front housing panel 330 may not be provided in the front housing panel 330, suppressing decrease in strength of the front housing panel 330.

A structure of the lever device 430 is similar to the structure of the lever device 400 depicted in FIG. 10. For example, the lever device 430 is provided on the front housing panel 330 in such a manner that the lever device 400 is rotated by 180 degrees from the position of the lever device 400 provided on the front housing panel 300 as illustrated in FIG. 13. Therefore, descriptions about the structure of the lever device 430 and operations of the lever 431 and the shutter 432 included in the lever device 430 to move the transfer rollers 209C, 209M, 209Y, and 209K with respect to the photoconductors 206C, 206M, 206Y, and 206K, respectively, are omitted.

Like in the image forming apparatus P1 depicted in FIG. 11, elements for moving the transfer rollers 209C, 209M, 209Y, and 209K with respect to the photoconductors 206C, 206M, 206Y, and 206K, respectively, such as a moving cam included in a moving mechanism provided in the lever device 430 or the sheet conveyor 200, may be provided in the image forming apparatus P2. Accordingly, the lever 431 serving as a lever and the shutter 432 serving as a regulating member, which are included in the lever device 430, regulate attachment and detachment of the photoconductor units 204C, 204M, 204Y, and 204K and the sheet conveyor 200 to and from the image forming apparatus P2. Consequently, when the transfer rollers 209C, 209M, 209Y, and 209K are pressed against the photoconductors 206C, 206M, 206Y, and 206K, respectively, via the transfer-conveyor belt 201 depicted in FIG. 17, the user cannot attach and detach the photoconductor units 204C, 204M, 204Y, and 204K and the sheet conveyor 200 to and from the image forming apparatus P2, preventing or reducing damage to the surfaces of the photoconductors 206C, 206M, 206Y, and 206K and the surface of the transfer-conveyor belt 201.

Further, like in the image forming apparatus P1, when the user cannot operate the lever device 430 properly, the user notices that the photoconductor units 204C, 204M, 204Y, 204K and the sheet conveyor 200 are not set in the image forming apparatus P2 properly, preventing an operation error of the user of causing the image forming apparatus P2 to perform an image forming operation when the photoconductor units 204C, 204M, 204Y, and 204K and the sheet conveyor 200 are not set in the image forming apparatus P2 properly.

As described above, in the image forming apparatus P1 depicted in FIG. 1, the development devices 9Y, 9M, 9C, and 9K serving as toner image formation members form toner images on the photoconductors 1Y, 1M, 1C, and 1K serving as image carriers, respectively. The intermediate transfer unit 51 serving as a belt unit includes the intermediate transfer belt 10 serving as a loop-shaped belt, the driving roller 12, the tension roller 13, the support roller 14, and the support roller 15 serving as a plurality of support members, the first transfer rollers 11Y, 11M, 11C, and 11K serving as transfer members, and the moving cam 701 (depicted in FIG. 11) serving as a moving member.

The plurality of support members, which are the driving roller 12, the tension roller 13, the support roller 14, and the support roller 15, rotatably support the intermediate transfer belt 10. The first transfer rollers 11Y, 11M, 11C, and 11K are movably provided inside a loop formed by the intermediate transfer belt 10 to transfer the toner images formed on the photoconductors 1Y, 1M, 1C, and 1K, respectively, onto the intermediate transfer belt 10. The moving cam 701 is provided inside the loop formed by the intermediate transfer belt 10 to move the first transfer rollers 11Y, 11M, 11C, and 11K between a contact position at which the first transfer rollers 11Y, 11M, 11C, and 11K are pressed against the photoconductors 1Y, 1M, 1C, and 1K, respectively, via the intermediate transfer belt 10 and a separation position at which the first transfer rollers 11Y, 11M, 11C, and 11K separate from the photoconductors 1Y, 1M, 1C, and 1K, respectively. The front housing panel 300 serving as a first housing panel includes the opening 300A serving as a first opening sized to allow the photoconductors 1Y, 1M, 1C, and 1K to be attached to and detached from the image forming apparatus P1 in an axial direction of the plurality of support members. The side housing panel 301 (depicted in FIG. 3) serving as a second housing panel includes the opening 301A serving as a second opening sized to allow the intermediate transfer unit 51 to be attached to and detached from the image forming apparatus P1 in a direction perpendicular to the axial direction of the plurality of support members.

As illustrated in FIG. 11, the lever 401, serving as a lever provided in the lever device 400, is provided on an outer side of the front housing panel 300, and is provided with the engagement member 409 serving as a second engagement member to engage and disengage the engagement hole 702 serving as a first engagement member provided in the moving cam 701 in the axial direction of the plurality of support members. The lever 401 is movable between a predetermined first position and a second position different from the first position to move the moving cam 701. When the lever 401 is at the first position, the first transfer rollers 11Y, 11M, 11C, and 11K reach the contact position at which the first transfer rollers 11Y, 11M, 11C, and 11K are pressed against the photoconductors 1Y, 1M, 1C, and 1K, respectively. When the lever 401 is at the second position, the first transfer rollers 11Y, 11M, 11C, and 11K reach the separation position at which the first transfer rollers 11Y, 11M, 11C, and 11K separate from the photoconductors 1Y, 1M, 1C, and 1K, respectively.

Thus, unlike the reference image forming apparatus RP2 depicted in FIG. 9 in which the lever device 420 is provided on the intermediate transfer unit 251 in an axial direction of support members supporting an intermediate transfer belt included in the intermediate transfer unit 251 so that the intermediate transfer unit 251 is attached to and detached from the reference image forming apparatus RP2 in a direction perpendicular to the axial direction of the support members, an opening for preventing the lever device 400 from interfering with the front housing panel 300 which is equivalent to the opening 820 for preventing the lever device 420 from interfering with the front housing panel 320X needs not be provided in the front housing panel 300 of the image forming apparatus P1 depicted in FIG. 7. Consequently, the front housing panel 300 of the image forming apparatus P1 can provide a strength greater than a strength of the front housing panel 320X of the reference image forming apparatus RP2, which has the opening 820.

In the image forming apparatus P2 depicted in FIG. 17, the development devices 208C, 208M, 208Y, and 208K serving as toner image formation members form toner images on the photoconductors 206C, 206M, 206Y, and 206K serving as image carriers, respectively. The sheet conveyor 200 serving as a belt unit includes the transfer-conveyor belt 201 serving as a loop-shaped belt, the support rollers 222 to 224 depicted in FIG. 16 serving as a plurality of support members, the transfer rollers 209C, 209M, 209Y, and 209K serving as transfer members, and the moving cam 701 (depicted in FIG. 11) serving as a moving member.

The plurality of support rollers 222 to 224 rotatably support the transfer-conveyor belt 201. The transfer rollers 209C, 209M, 209Y, and 209K are movably provided inside a loop formed by the transfer-conveyor belt 201 to transfer the toner images formed on the photoconductors 206C, 206M, 206Y, and 206K, respectively, onto a transfer sheet 225 serving as a sheet or a transfer material carried by the transfer-conveyor belt 201. The moving cam 701 serving as a moving member is provided inside the loop formed by the transfer-conveyor belt 201 to move the transfer rollers 209C, 209M, 209Y, and 209K between a contact position at which the transfer rollers 209C, 209M, 209Y, and 209K are pressed against the photoconductors 206C, 206M, 206Y, and 206K, respectively, via the transfer-conveyor belt 201 and a separation position at which the transfer rollers 209C, 209M, 209Y, and 209K separate from the photoconductors 206C, 206M, 206Y, and 206K, respectively. The front housing panel 330 (depicted in FIG. 19) serving as a first housing panel includes the opening 330A serving as a first opening sized to allow the photoconductors 206C, 206M, 206Y, and 206K to be attached to and detached from the image forming apparatus P2 in an axial direction of the plurality of support rollers 222 to 224. The side housing panel 302 (depicted in FIG. 18) serving as a second housing panel includes the opening 302A serving as a second opening sized to allow the sheet conveyor 200 to be attached to and detached from the image forming apparatus P2 in a direction perpendicular to the axial direction of the plurality of support rollers 222 to 224.

As illustrated in FIG. 19, the lever 431 serving as a lever provided in the lever device 430 is provided on an outer side of the front housing panel 330, and is provided with the engagement member 409 (depicted in FIG. 11) serving a second engagement member to engage and disengage the engagement hole 702 (depicted in FIG. 11) serving as a first engagement member provided in the moving cam 701 in the axial direction of the plurality of support rollers 222 to 224. The lever 431 is movable between a predetermined first position and a second position different from the first position to move the moving cam 701. When the lever 431 is at the first position, the transfer rollers 209C, 209M, 209Y, and 209K reach the contact position at which the transfer rollers 209C, 209M, 209Y, and 209K are pressed against the photoconductors 206C, 206M, 206Y, and 206K, respectively. When the lever 431 is at the second position, the transfer rollers 209C, 209M, 209Y, and 209K reach the separation position at which the transfer rollers 209C, 209M, 209Y, and 209K separate from the photoconductors 206C, 206M, 206Y, and 206K, respectively.

Thus, unlike the reference image forming apparatus RP2 depicted in FIG. 9 in which the lever device 420 is provided on the intermediate transfer unit 251 in an axial direction of support members supporting an intermediate transfer belt included in the intermediate transfer unit 251 so that the intermediate transfer unit 251 is attached to and detached from the reference image forming apparatus RP2 in a direction perpendicular to the axial direction of the support members, an opening for preventing the lever device 430 from interfering with the front housing panel 330 which is equivalent to the opening 820 depicted in FIG. 9 for preventing the lever device 420 from interfering with the front housing panel 320X needs not be provided in the front housing panel 330 of the image forming apparatus P2 depicted in FIG. 19. Consequently, the front housing panel 330 of the image forming apparatus P2 can provide a strength greater than a strength of the front housing panel 320X of the reference image forming apparatus RP2, which has the opening 820.

In the image forming apparatus P1 depicted in FIG. 11, when the lever 401 serving as a lever is at the first position, the shutter 402 serving as a regulating member and the engagement member 409 mounted on the lever 401 regulate movement of the photoconductors 1Y, 1M, 1C, and 1K and the intermediate transfer unit 51 to prevent the photoconductors 1Y, 1M, 1C, and 1K and the intermediate transfer unit 51 from being attached to and detached from the image forming apparatus P1, respectively. By contrast, when the lever 401 is at the second position, the regulation by the shutter 402 and the engagement member 409 is released to allow the photoconductors 1Y, 1M, 1C, and 1K and the intermediate transfer unit 51 to be attached to and detached from the image forming apparatus P1, respectively.

Thus, when the photoconductors 1Y, 1M, 1C, and 1K and the intermediate transfer unit 51 are attached to and detached from the image forming apparatus P1, the surfaces of the photoconductors 1Y, 1M, 1C, and 1K and the surface of the intermediate transfer belt 10 depicted in FIG. 1 are not damaged.

Similarly, in the image forming apparatus P2 depicted in FIG. 19, when the lever 431 serving as a lever is at the first position, the shutter 432 serving as a regulating member and the engagement member 409 (depicted in FIG. 11) mounted on the lever 431 regulate movement of the photoconductors 206C, 206M, 206Y, and 206K depicted in FIG. 17 and the sheet conveyor 200 depicted in FIG. 16 to prevent the photoconductors 206C, 206M, 206Y, and 206K and the sheet conveyor 200 from being attached to and detached from the image forming apparatus P2, respectively. By contrast, when the lever 431 is at the second position, the regulation by the shutter 432 and the engagement member 409 is released to allow the photoconductors 206C, 206M, 206C, and 206K and the sheet conveyor 200 to be attached to and detached from the image forming apparatus P2, respectively.

Thus, when the photoconductors 206C, 206M, 206Y, and 206K and the sheet conveyor 200 are attached to and detached from the image forming apparatus P2, the surfaces of the photoconductors 206C, 206M, 206Y, and 206K and the surface of the transfer-conveyor belt 201 depicted in FIG. 16 are not damaged.

In the image forming apparatus P1 depicted in FIG. 11, when the lever 401 is not at the first position, the image forming apparatus P1 does not perform an image forming operation. Accordingly, a malfunction of performing the image forming operation is prevented when the photoconductors 1Y, 1M, 1C, and 1K and the intermediate transfer unit 51 depicted in FIG. 1 are not set in the image forming apparatus P1 properly.

Similarly, in the image forming apparatus P2 depicted in FIG. 19, when the lever 431 is not at the first position, the image forming apparatus P2 does not perform an image forming operation. Accordingly, a malfunction of performing the image forming operation is prevented when the photoconductors 206C, 206M, 206Y, and 206K depicted in FIG. 17 and the sheet conveyor 200 depicted in FIG. 16 are not set in the image forming apparatus P2 properly.

In the image forming apparatus P1 depicted in FIG. 1, when the photoconductors 1Y, 1M, 1C, and 1K are not set at predetermined positions in the image forming apparatus P1, respectively, the shutter 402 depicted in FIG. 14 interferes with (e.g., strikes) the photoconductor 1K when the lever 401 is moved from the second position toward the first position to prevent the lever 401 from reaching the first position. Namely, the user cannot move the lever 401 from the second position to the first position.

Accordingly, the user notices that the photoconductors 1Y, 1M, 1C, and 1K are not set in the image forming apparatus P1 properly. In other words, the user can avoid an operation error of causing the image forming apparatus P1 to perform an image forming operation when the photoconductors 1Y, 1M, 1C, and 1K are not set in the image forming apparatus P1 properly.

Similarly, in the image forming apparatus P2 depicted in FIG. 16, when the photoconductors 206C, 206M, 206Y, and 206K are not set at predetermined positions in the image forming apparatus P2, respectively, the shutter 432 depicted in FIG. 19 interferes with (e.g., strikes) the photoconductor 206K when the lever 431 depicted in FIG. 19 is moved from the second position toward the first position to prevent the lever 431 from reaching the first position. Namely, the user cannot move the lever 431 from the second position to the first position.

Accordingly, the user notices that the photoconductors 206C, 206M, 206Y, and 206K are not set in the image forming apparatus P2 properly. In other words, the user can avoid an operation error of causing the image forming apparatus P2 to perform an image forming operation when the photoconductors 206C, 206M, 206Y, and 206K are not set in the image forming apparatus P2 properly.

In the image forming apparatus P1 depicted in FIG. 15, when the intermediate transfer unit 51 is not set at a predetermined position in the image forming apparatus P1, the engagement member 409 interferes with (e.g., does not engage) the engagement hole 702 provided in the intermediate transfer unit 51 when the lever 401 is moved from the second position toward the first position to prevent the lever 401 from reaching the first position. Namely, the user cannot move the lever 401 from the second position to the first position.

Accordingly, the user notices that the intermediate transfer unit 51 is not set in the image forming apparatus P1 properly. In other words, the user can avoid an operation error of causing the image forming apparatus P1 to perform an image forming operation when the intermediate transfer unit 51 is not set in the image forming apparatus P1 properly.

Similarly, in the image forming apparatus P2 depicted in FIG. 19, when the sheet conveyor 200 is not set at a predetermined position in the image forming apparatus P2, the engagement member 409 interferes with (e.g., does not engage) the engagement hole 702 provided in the sheet conveyor 200 when the lever 431 is moved from the second position toward the first position to prevent the lever 431 from reaching the first position. Namely, the user cannot move the lever 431 from the second position to the first position.

Accordingly, the user notices that the sheet conveyor 200 is not set in the image forming apparatus P2 properly. In other words, the user can avoid an operation error of causing the image forming apparatus P2 to perform an image forming operation when the sheet conveyor 200 is not set in the image forming apparatus P2 properly.

In the image forming apparatus P1 depicted in FIG. 11, the lever 401 serving as a lever is provided not on the intermediate transfer unit 51 serving as a belt unit but on an outer side of the front housing panel 300 serving as a first housing panel of the image forming apparatus P1 in such a manner that the lever 401 engages and disengages the moving cam 701 serving as a moving member in an axial direction of the driving roller 12, the tension roller 13, and the support rollers 14 and 15 serving as a plurality of support members. The user disengages the lever 401 from the moving cam 701 to remove the intermediate transfer unit 51 from the image forming apparatus P1.

Therefore, an opening having a small size capable of engaging the lever 401 with the moving cam 701 when the intermediate transfer unit 51 is attached to the image forming apparatus P1 is provided in the front housing panel 300. In other words, a large opening equivalent to the opening 820 provided in the conventional, reference image forming apparatus RP2 depicted in FIG. 9 is not provided in the front housing panel 300 to correspond to an orbit on which the lever 401 moves to detach the intermediate transfer unit 51 from the image forming apparatus P1. Accordingly, the front housing panel 300 of the image forming apparatus P1 provides a strength greater than a strength of the front housing panel 320X provided with the opening 820 corresponding to an orbit on which the lever device 420 (depicted in FIG. 9) moves so as to prevent the lever device 420 from interfering with the front housing panel 320X when the intermediate transfer unit 251 is attached to and detached from the reference image forming apparatus RP2.

Consequently, the image forming apparatus P1 can suppress decrease in strength of the front housing panel 300.

Similarly, in the image forming apparatus P2 depicted in FIG. 19, the lever 431 serving as a lever is provided not on the sheet conveyor 200 (depicted in FIG. 16) serving as a belt unit but on an outer side of the front housing panel 330 serving as a first housing panel of the image forming apparatus P2 in such a manner that the lever 431 engages and disengages the moving cam 701 (depicted in FIG. 11) serving as a moving member in an axial direction of the support rollers 222 to 224 (depicted in FIG. 16) serving as a plurality of support members. The user disengages the lever 431 from the moving cam 701 to remove the sheet conveyor 200 from the image forming apparatus P2.

Therefore, an opening having a small size capable of engaging the lever 431 with the moving cam 701 when the sheet conveyor 200 is attached to the image forming apparatus P2 is provided in the front housing panel 330. In other words, a large opening equivalent to the opening 820 provided in the conventional, reference image forming apparatus RP2 depicted in FIG. 9 is not provided in the front housing panel 330 to correspond to an orbit on which the lever 431 moves to detach the sheet conveyor 200 from the image forming apparatus P2. Accordingly, the front housing panel 330 of the image forming apparatus P2 provides a strength greater than a strength of the front housing panel 320X provided with the opening 820 corresponding to an orbit on which the lever device 420 (depicted in FIG. 9) moves so as to prevent the lever device 420 from interfering with the front housing panel 320X when the intermediate transfer unit 251 is attached to and detached from the reference image forming apparatus RP2.

Consequently, the image forming apparatus P2 can suppress decrease in strength of the front housing panel 330.

In the image forming apparatus P1 depicted in FIG. 3, the image forming units 120Y, 120M, 120C, and 120K are attached to and detached from the image forming apparatus P1 from the front side of the image forming apparatus P1, and the intermediate transfer unit 51 is attached to and detached from the image forming apparatus P1 from the right side of the image forming apparatus P1. Alternatively, the image forming units 120Y, 120M, 120C, and 120K may be attached to and detached from the image forming apparatus P1 from other side (e.g., the right side, a left side, a top side, or a rear side) of the image forming apparatus P1. Accordingly, the intermediate transfer unit 51 may be attached to and detached from the image forming apparatus P1 from other side perpendicular to the side from which the image forming units 120Y, 120M, 120C, and 120K are attached to and detached from the image forming apparatus P1.

Similarly, in the image forming apparatus P2 depicted in FIG. 18, the photoconductor units 204C, 204M, 204Y, and 204K are attached to and detached from the image forming apparatus P2 from the front side of the image forming apparatus P2, and the sheet conveyor 200 is attached to and detached from the image forming apparatus P2 from the right side of the image forming apparatus P2. Alternatively, the photoconductor units 204C, 204M, 204Y, and 204K may be attached to and detached from the image forming apparatus P2 from other side (e.g., the right side, a left side, a top side, or a rear side) of the image forming apparatus P2. Accordingly, the sheet conveyor 200 may be attached to and detached from the image forming apparatus P2 from other side perpendicular to the side from which the photoconductor units 204C, 204M, 204Y, and 204K are attached to and detached from the image forming apparatus P2.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus comprising:

an image carrier;

a toner image formation member to form a toner image on the image carrier;

a belt unit comprising:

a loop-shaped belt;

a plurality of support members to rotatably support the belt;

a transfer member movably provided inside a loop formed by the belt to transfer the toner image formed on the image carrier onto one of the belt and a sheet carried by the belt; and a moving member provided inside the loop formed by the belt to move the transfer member between a contact position at which the transfer member is pressed against the image carrier via the belt and a separation position at which the transfer member separates from the image carrier, the moving member being provided with a first engagement member;

a first housing panel comprising a first opening sized to allow the image carrier to be attached to and detached from the image forming apparatus in an axial direction of the plurality of support members;

a second housing panel comprising a second opening sized to allow the belt unit to be attached to and detached from the image forming apparatus in a direction perpendicular to the axial direction of the plurality of support members; and a lever provided on an outer side of the first housing panel, the lever being provided with a second engagement member to engage and disengage the first engagement member provided in the moving member in the axial direction of the plurality of support members, the lever movable between a predetermined first position and a second position different from the first position to move the moving member in such a manner that when the lever is at the first position, the transfer member reaches the contact position, and when the lever is at the second position, the transfer member reaches the separation position, wherein the lever moves from the second position to the first position as the lever moves in a first direction parallel to the axial direction of the plurality of support members to engage the second engagement member with the first engagement member, after which the lever is able to rotate in a second rotation direction to rotate the moving member in the second rotation direction.

2. The image forming apparatus according to claim 1, wherein the belt comprises an intermediate transfer belt, and the toner image formed on the image carrier is transferred onto the sheet via the intermediate transfer belt.

3. The image forming apparatus according to claim 1, wherein the belt comprises a transfer-conveyor belt for carrying and conveying the sheet.

4. The image forming apparatus according to claim 1, further comprising:

a regulating member provided on the lever for movement with the lever between the predetermined first position and second position, wherein when the lever is at the first position, the regulating member and the second engagement member regulate movement of the image carrier and the belt unit to prevent the image carrier and the belt unit from being attached to and detached from the image forming apparatus, respectively, and wherein when the lever is at the second position, the regulation by the regulating member and the second engagement member is released to allow the image carrier and the belt unit to be attached to and detached from the image forming apparatus, respectively.

5. The image forming apparatus according to claim 4, wherein when the lever is not at the first position, the image forming apparatus does not perform an image forming operation.

6. The image forming apparatus according to claim 4, wherein when the image carrier is not set at a predetermined position in the image forming apparatus, the regulating member strikes the image carrier when the lever is moved from the second position toward the first position to prevent the lever from reaching the first position.

7. The image forming apparatus according to claim 4, wherein when the belt unit is not set at a predetermined position in the image forming apparatus, the second engagement member of the lever does not engage the first engagement member of the moving member provided in the belt unit when the lever is moved from the second position toward the first position to prevent the lever from reaching the first position.

8. The image forming apparatus according to claim 1, further comprising a spring connected to the lever to apply a force to the lever, wherein when the lever is at the second position, the force applied by the spring to the lever disengages the second engagement member from the first engagement member.

* * * * *